US009079708B2

(12) United States Patent
Takai

(10) Patent No.: US 9,079,708 B2
(45) Date of Patent: Jul. 14, 2015

(54) STORAGE COMPOSITE, AND STORAGE TANK AND PERMEABLE STORAGE TANK USING SAME

(75) Inventor: Seiichiro Takai, Tokyo (JP)

(73) Assignee: TOTETU MFG. CO. LTD., Tokyo (JP)

( * ) Notice: Subject to any disclaimer, the term of this patent is extended or adjusted under 35 U.S.C. 154(b) by 0 days.

(21) Appl. No.: 13/978,244

(22) PCT Filed: Feb. 6, 2012

(86) PCT No.: PCT/JP2012/052610

§ 371 (c)(1),
(2), (4) Date: Jul. 3, 2013

(87) PCT Pub. No.: WO2012/111465

PCT Pub. Date: Aug. 23, 2012

(65) Prior Publication Data

US 2013/0284750 A1 Oct. 31, 2013

(30) Foreign Application Priority Data

Feb. 14, 2011 (JP) ..... 2011-028530

(51) Int. Cl.
*B65D 90/12* (2006.01)
*E03F 1/00* (2006.01)
*B65D 90/02* (2006.01)

(52) U.S. Cl.
CPC ..... *B65D 90/12* (2013.01); *E03F 1/002* (2013.01); *E03F 1/005* (2013.01); *B65D 90/02* (2013.01)

(58) Field of Classification Search
CPC ..... B65D 88/128; B65D 90/12; B65D 90/02; B65D 90/04; B65D 90/041; B65D 90/52; F17C 1/08; F17C 2203/00; F17C 2203/012; F15D 1/0005; E03F 1/005; E03F 1/002
USPC ..... 220/565, 651, 507, 500–503, 563, 553
See application file for complete search history.

(56) References Cited

U.S. PATENT DOCUMENTS 6,626,609 B1 9/2003 Kotani et al.
2008/0166182 A1 7/2008 Smith et al.

FOREIGN PATENT DOCUMENTS

CN 101476386 7/2009
CN 101115888 9/2010

(Continued)

OTHER PUBLICATIONS

China Office action, dated Mar. 19, 2014 with English translation.

(Continued)

*Primary Examiner* — Andrew Perreault
(74) *Attorney, Agent, or Firm* — Greenblum & Bernstein, P.L.C.

(57) ABSTRACT

The interior of a storage tank is filled with a storage composite and one cylindrical rib is positioned on each of the lower surface and the upper surface of partitions to project therefrom. Funnel-shaped end spacers have a large-diameter tube portion for engaging with and connecting to the cylindrical ribs on the upper and lower surfaces of the partitions, and a small-diameter tube portion having a smaller diameter than the large-diameter tube portion. Both ends of cylindrical connecting spacers engages with the small-diameter tube portion of a pair of end spacers, and the length of one side of a partition is S, the diameter of the section in which the cylindrical rib engages the large-diameter tube is set within the range of 0.40 S to 0.95 S. Multiple levels of horizontal connected units are provided, and end spacers and connecting spacers are interposed between the horizontal connected units of multiple levels.

12 Claims, 19 Drawing Sheets

(56) References Cited

FOREIGN PATENT DOCUMENTS

| | | |
|---|---|---|
| DE | 202006011483 | 9/2006 |
| EP | 1997970 | 12/2008 |
| JP | 2003-020696 | 1/2003 |
| JP | 2007-056611 | 3/2007 |
| JP | 2007-56611 | 3/2007 |
| JP | 2008-038457 | 2/2008 |
| JP | 2008-231683 | 10/2008 |
| JP | 2008-255767 | 10/2008 |
| TW | 482844 | 4/2002 |

OTHER PUBLICATIONS

Taiwan Office Action, mail date is Dec. 25, 2013 along with its English translation.

Korea Office Action, mail date is Feb. 13, 2014 along with its English translation.

International Search Report dated May 15, 2012 with English language translation.

International Preliminary Report on Patentability dated Aug. 21, 2013 with English language translation.

FIG. 6
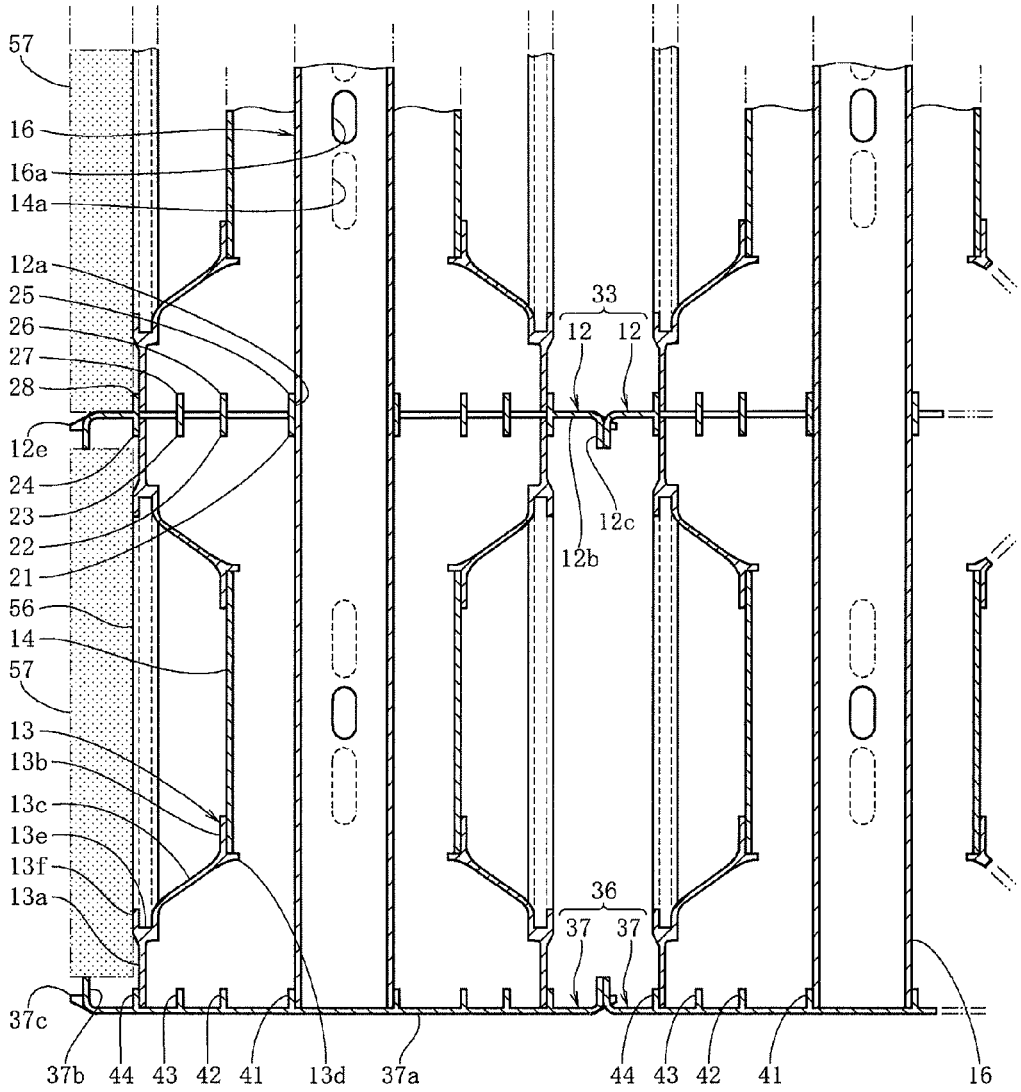
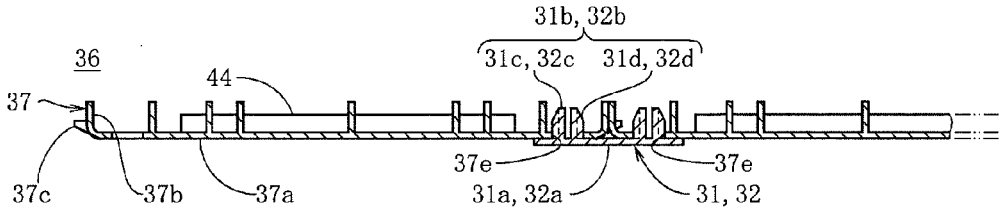
FIG. 7

FIG. 8
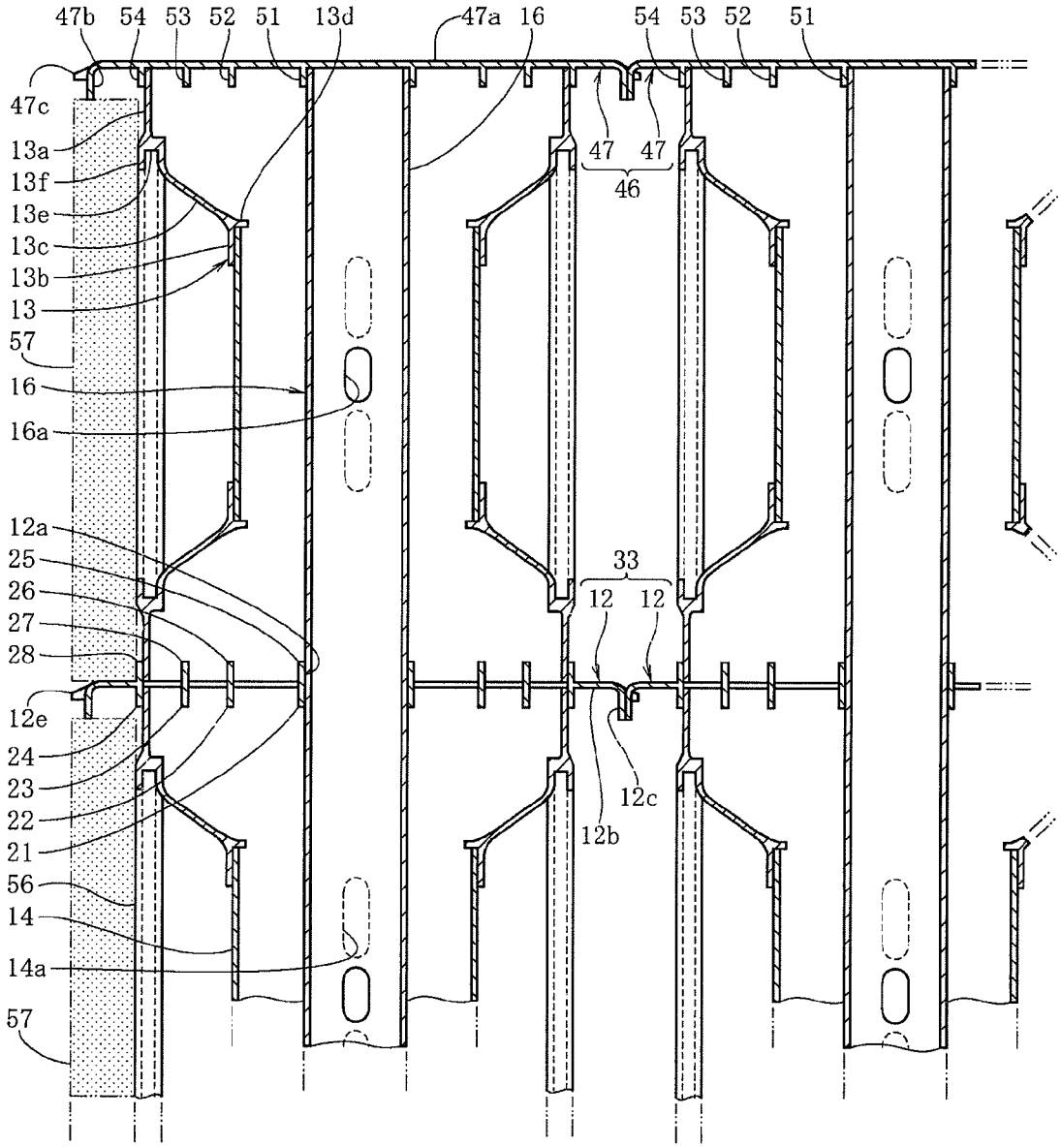
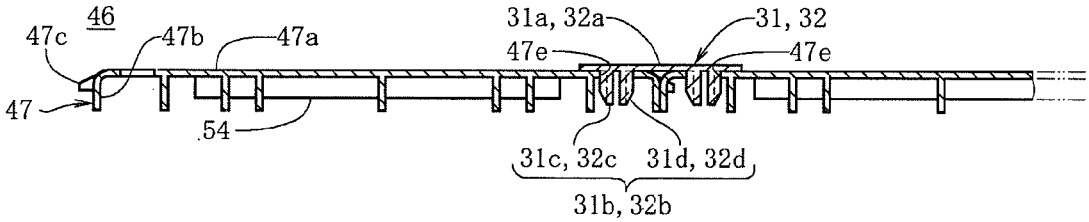
FIG. 9

STORAGE COMPOSITE, AND STORAGE TANK AND PERMEABLE STORAGE TANK USING SAME

TECHNICAL FIELD

The present invention relates to a storage composite that fills the inside of a storage tank that stores rainwater and others or a permeable storage tank that temporarily stores rainwater and others, and to a storage tank and a permeable storage tank using this storage composite.

BACKGROUND ART

There has been conventionally disclosed a permeable storage facility for rainwater and others in which a tabular member formed of flat plates and cylindrical portions opened in the flat plate is arranged below ground to form a rainwater storage space and each reinforcing material that extends in a horizontal direction is arranged between the flat plates of the tabular member which are adjacent to each other (see, e.g., Patent Reference 1). In this permeable storage facility, the cylindrical portions of the plurality of tabular members are stacked so as to abut on each other, and the vertical reinforcing materials are pierced in these cylindrical portions. Materials used for the reinforcing material extending in the horizontal direction and the reinforcing material extending in the vertical direction may be a metal such as stainless steel, concrete, or FRP (Fiber Reinforced Plastics) made of a resin and fibers. Further, shapes of the reinforcing material extending in the horizontal direction and the reinforcing material extending in the vertical direction may be a U-like shape, a prismatic shape, or an L-like shape.

To form the storage space of the thus configured permeable storage facility, first, the tabular member on a first level is arranged together with the reinforcing material extending in the horizontal direction, and the reinforcing material extending in the vertical direction is inserted into and erected in the cylindrical portion of the tabular member. Then, the tabular member on a second level is arranged in such a manner that its cylindrical portion abuts on the cylindrical portion of the tabular member on the first level, and the reinforcing material extending in the horizontal direction is fitted into a groove provided in the flat plate of the tabular member on the second level. Subsequently, the tabular member on a third level is laminated so as to be matched with the reinforcing material extending in the horizontal direction. Moreover, the tabular members and the reinforcing materials extending in the horizontal direction are sequentially overlapped, and an upper end of the reinforcing material extending in the vertical direction and the reinforcing material extending in the horizontal direction on the highest level are fixed.

In the thus configured permeable storage facility, the reinforcing material extending in the vertical direction is inserted so as to penetrate through the cylindrical portion forming the tabular member, and the reinforcing material extending in the horizontal direction is inserted between the flat plates forming the tabular member, thereby reinforcing the permeable storage facility.

CITATION LIST

Patent Literatures

Patent Literature 1: Japanese Unexamined Patent Application Publication No. 2008-255767 (claim 2, claim 3, paragraph [0006], paragraph [0007], paragraph [0012], paragraph [0014], FIG. 4, FIG. 8)

DISCLOSURE OF INVENTION

Problem to be Solved by the Invention

However, in the permeable storage facility disclosed in the conventional Patent Literature 1, since each flat plate and each cylindrical portion constituting the tabular member are integrally formed, the tabular member has a relatively complicated shape, and the number of steps for manufacturing molds for forming the tabular member is inconveniently increased. Additionally, in the permeable storage facility disclosed in the conventional Patent Literature 1, since a cross-sectional area of the cylindrical portion is relatively smaller than a surface area of the flat plate of the tabular member, when an operator mounts the flat plate at a position where the horizontal reinforcing material is not used at the time of assembling the permeable storage facility, the flat plate may possibly deform or strain, and operating efficiency may be possibly lowered. Further, since the permeable storage facility disclosed in the conventional Patent Literature 1 adopts the configuration that a displacement of the flat plates of the tabular members adjacent to each other is prevented by the reinforcing material extending in the horizontal direction, when an operator mounts the flat plate of the tabular member and tries to work before providing the reinforcing material extending in the horizontal direction, there occurs a problem that the flat plate of the tabular member deforms, an operation becomes unstable, and operability is lowered, or the flat plate of the tabular member is damaged. Furthermore, in the permeable storage facility disclosed in the conventional Patent Literature 1, since the laminated tabular members all have the same shape along the vertical direction, even if desired strength is obtained by the lower tabular member, excessive strength is assured in the upper tabular member, there arises a problem that the configuration becomes wasteful. Furthermore, in the permeable storage facility disclosed in the conventional Patent Literature 1, since each tabular member, each reinforcing material extending in the horizontal direction, and the reinforcing material extending in the vertical direction constituting this permeable storage facility are all exclusive goods, there is a drawback that a material cost increases, and there is a problem that wastes (e.g., a waste pipe) such as a vinyl chloride pipe that cannot be easily discarded cannot be used.

It is a first object of the present invention to provide a storage composite, and a storage tank and a permeable storage tank using this which enable reducing the number of steps for manufacturing molds for forming members such as partitions, end spacers, connecting spacers, and others having relatively simple shapes by using these members and also enable using material without waste. It is a second object of the present invention to provide a storage composite, and a storage tank and a permeable storage tank using this which can improve operating efficiency when each partition is stably supported by each end spacer even though an operator mounts a horizontal connected unit at the time of assembling. It is a third object of the present invention to provide a storage composite, and a storage tank and a permeable storage tank using this which can prevent partitions adjacent to each other from being displaced in the vertical direction even though an operator mounts a horizontal connected unit at the time of assembling since the partitions adjacent to each other are engaged through a convex portion and a concave portion and can also prevent assembling operability from being spoiled since directivity of the partitions does not have to be considered at the time of connection. It is a fourth object of the present invention to provide a storage composite, and a storage tank and a permeable storage tank using this which can decrease strength of an upper side and exclude structural wastes by increasing each vertical interval between horizontal connected plates of multiple levels on the upper side than a lower side. It is a fifth object of the present invention to provide a storage composite, and a storage tank and a permeable storage tank using this which use waste pipes as spacers so that the waste pipes having difficulty in disposal can be effectively used.

Means for Solving Problem

According to a first aspect of the present invention, as shown in FIG. 1 to FIG. 3, FIG. 6, FIG. 8, and FIG. 10, there is provided a storage composite 11 which fills the inside of a storage tank or a permeable storage tank, comprising: a plurality of partitions 12 having a square plate shape, each of which has at least one cylindrical rib 24 protruded on a lower surface thereof and at least one cylindrical rib 28 protruded on an upper surface thereof; a plurality of funnel-shaped end spacers 13, each of which has a large-diameter cylindrical portion 13*a* that is connected to one or both of the lower surface and the upper surface of the partition 12 while being fitted on the cylindrical rib 24, 28, and a small-diameter cylindrical portion 13*b* which is integrally formed with the large-diameter cylindrical portion 13*a* and formed with a diameter smaller than the large-diameter cylindrical portion 13*a*; and a plurality of cylindrical connecting spacers 14, each of which has both ends fitted in the small-diameter cylindrical portions 13*b*, 13*b* of a pair of end spacers 13, 13 facing each other and extends in a vertical direction, wherein a diameter T of a portion of the cylindrical rib 24, 28 fitted into the large-diameter cylindrical portion 13*a* is set to fall within the range of 0.40S to 0.95S where S is a length of one side of the partition 12, horizontal connected units 33, each of which is configured by aligning the plurality of partitions 12 on the same horizontal planes and coupling them, are provided on a plurality of levels, and the end spacers 13 and the connecting spacers 14 are interposed between the horizontal connected units 33 on the plurality of levels.

Further, according to a second aspect of the present invention, as shown in FIG. 1 to FIG. 3, FIG. 6, FIG. 8, and FIG. 10, the invention based on the first aspect is characterized in that an insertion hole 12*a* is formed at the center of each of the plurality of partitions 12, and a spindle pipe 16 is vertically inserted into the insertion hole 12*a* of each partition 12 constituting each of the horizontal connected units 33 on the plurality of levels.

Furthermore, according to a third aspect of the present invention, as shown in FIG. 1, FIG. 6, and FIG. 8, the invention based on the first aspect is characterized in that a plurality of bottom plates 37 are formed by flatly forming a lower surface of each of the plurality of partitions constituting the horizontal connected unit 36 on the lowest level, and a plurality of top panels 47 are formed by flatly forming an upper surface of each of the plurality of partition constituting the horizontal connected unit 46 on the highest level.

Moreover, according to a fourth aspect of the present invention, as shown in FIG. 15, the invention based on the first aspect is characterized in that each vertical interval between the horizontal connected units 33, 36, 46 on the plurality of levels is configured to be larger on an upper side than on a lower side.

Additionally, according to a fifth aspect of the present invention, as shown in FIG. 2, FIG. 3, FIG. 10, FIG. 12, and FIG. 13, the invention based on the first aspect is characterized in that a convex portion 12*e* and a concave portion 12*f* are provided on each of four side surfaces of the partition 12, the convex portion 12*e* of the partition 12 engages with the concave portion 12*f* of a partition 12 adjacent to the partition 12, and the concave portion 12*f* of the partition 12 engages with the convex portion 12*e* of a partition 12 adjacent to the partition 12.

Further, according to a sixth aspect of the present invention, as shown in FIG. 21 to FIG. 24, the invention based on the fifth aspect is characterized in that the partition 112 comprises: a partition main body 112*b* having a square plate shape; and a square tube rib 112*c* having a square frame shape protruded on each of an upper side and a lower side of the partition main body 112*b* over an entire outer periphery of the partition main body 112*b*, the convex portion 113 comprises: a plurality of first convex portions 113*a* having a rectangular plate shape which are provided on an outer peripheral surface of the square tube rib 112*c* above the partition main body 112*b* in a longitudinal direction of the outer peripheral surface of the square tube rib 112*c* at predetermined intervals; and a plurality of second convex portions 113*b* having a rectangular plate shape which are provided on the outer peripheral surface of the square tube rib 112*c* below the partition main body 112*b* in the longitudinal direction of the outer peripheral surface of the square tube rib 112*c* at predetermined intervals, the concave portion 114 comprises: a first concave portion 114*a* provided between the plurality of first convex portions 113*a*; and a second concave portion 114*b* provided between the plurality of second convex portions 113*b*, the first convex portion 113*a* is placed immediately below the second concave portion 114*b*, the second convex portion 113*b* is placed immediately above the first concave portion 114*a*, and the first and second convex portions 113*a*, 113*b* and the first and second concave portions 114*a*, 114*b* are thereby arranged on the outer peripheral surface of the square tube rib 112*c* in a reticular pattern, and the first convex portion 113*a* of the partition 112 engages with the first or second concave portion 114*a*, 114*b* of a partition 112 adjacent to the partition 112, and the second convex portion 113*b* of the partition 112 engages with the second or first concave portion 114*b*, 114*a* of the partition 112 adjacent to the partition 112.

According to a seventh aspect of the present invention, as shown in FIG. 16 to FIG. 19, there is provided a storage composite 91 which fills the inside of a storage tank or a permeable storage tank, comprising: a plurality of partitions 12 having a square plate shape, each of which has an insertion hole 12*a* formed at the center, a plurality of cylindrical ribs 21 to 24 protruded on a lower surface thereof concentrically with the insertion hole 12*a*, and a plurality of cylindrical ribs 25 to 28 protruded on an upper surface thereof concentrically with the insertion hole 12*a*; a plurality of frustum cylindrical or cylindrical spacers 93 connected to one or both the lower surface and the upper surface of the partition 12 so as to be movably inserted into any one of a plurality of ring grooves between the plurality of cylindrical ribs 21 to 28; and a spindle pipe 16 inserted into the insertion hole 12*a* of each partition 12, wherein horizontal connected units 33, which are configured by aligning the plurality of partition 12 on the same horizontal plane and coupling them, are provided on a plurality of levels, the spacer 93 is interposed between the horizontal connected units 33 on the plurality of levels, the spindle pipe 16 is vertically inserted into the insertion hole 12*a* of each of the partitions 12 constituting the horizontal connected units 33 on the plurality of levels, a convex portion 12*e* and a concave portion 12*f* are provided on each of four side surfaces of the partition 12, the convex portion 12*e* of the partition 12 engages with the concave portion 12*f* of a partition 12 adjacent to the partition 12, and the concave portion 12*f* of the partition 12 engages with the convex portion 12*e* of a partition 12 adjacent to the partition 12.

Furthermore, according to an eighth aspect of the present invention, the invention based on the sixth aspect is characterized in that the partition comprises: a partition main body having a square plate shape, which has an insertion hole formed at the center; and a square tube rib having a square frame shape protruded on each of an upper side and a lower side of the partition main body over an enter outer periphery of the partition main body, the convex portion comprises: a plurality of first convex portions having a rectangular plate shape which are provided on an outer peripheral surface of the square tube rib above the partition main body in a longitudinal direction of the outer peripheral surface of the square tube rib at predetermined intervals; and a plurality of second convex portions having a rectangular plate shape which are provided on the outer peripheral surface of the square tube rib below the partition main body in the longitudinal direction of the outer peripheral surface of the square tube rib at predetermined intervals, the concave portion comprises: a first concave portion provided between the plurality of first convex portions; and a second concave portion provided between the plurality of second convex portions, the first convex portion is placed immediately below the second concave portion, the second convex portion is placed immediately above the first concave portion, and the first and second convex portions and the first and second concave portions are thereby arranged on the outer peripheral surface of the square tube rib in a reticular pattern, and the first convex portion of the partition engages with the first or second concave portion of a partition adjacent to the partition, and the second convex portion of the partition engages with the second or first concave portion of the partition adjacent to the partition.

According to a ninth aspect of the present invention, as shown in FIG. 3, FIG. 6, FIG. 8, and FIG. 14, there is provided a storage tank, wherein the storage tank is filled with the storage composite 11 according to any one of the first to sixth aspects, and foam plates 57 abut on the outermost surfaces of a plurality of end spacers 13 placed on the outermost side of a plurality of end spacers 13 in the filling storage composite 11, and the foam plates 57 thereby surround the end spacers 13 and the connecting spacers 14 between the horizontal connected units 33 on the plurality of stages.

According to a 10th aspect of the present invention, as shown in FIG. 18 to FIG. 20, there is provided a storage tank, wherein the storage tank is filled with the storage composite 91 according to the seventh or eighth aspect, and foam plates 57 abut on the outermost surfaces of a plurality of spacers 93 placed on the outermost side of a plurality of spacers 93 in the filling storage composite 91, and the foam plates 57 thereby surround the plurality of spacers 93 between the horizontal connected units 33 on the plurality of stages.

According to an 11th aspect of the present invention, there is provided a permeable storage tank, wherein the permeable storage tank is filled with the storage composite according to any one of the first to sixth aspects, and foam plates abut on the outermost surfaces of a plurality of end spacers placed on the outermost side of a plurality of end spacers in the filling storage composite, and the foam plates thereby surround the end spacers and the connecting spacers between the horizontal connected units on the plurality of stages.

According to a 12th aspect of the present invention, there is provided a permeable storage tank, wherein the permeable storage tank is filled with the storage composite according to the seventh or eighth aspect, and foam plates abut on the outermost surfaces of a plurality of spacers placed on the outermost side of a plurality of spacers in the filling storage composite, and the foam plates thereby surround the plurality of spacers between the horizontal connected units on the plurality of stages.

Effect of the Invention

In the storage composite according to the first aspect of the present invention, assuming that S is a length of one side of a partition, the diameter T of the cylindrical rib of the partition at the position where it fits to the large-diameter portion of the end spacer is set to fall within the range of 0.40S to 0.95S, the horizontal connected units each of which is configured by aligning and connecting the plurality of partitions with each within the same horizontal plane are provided on the plurality of levels, the end spacers and the connecting spacers are interposed between the horizontal connected units of the plurality of levels, and hence a partial pressure in the vertical direction in external force that acts on the storage composite is received by the end spacers and the connecting spacers whilst a partial pressure in the horizontal direction in the external force that acts on the storage composite is mainly received by the horizontal connected units. As a result, even the storage composite formed by assembling the members having relatively simple shapes can assure strength of a relatively large structure. Further, as compared with a conventional permeable storage facility in which a tabular member has a relatively complicated shape since a flat plate and a cylindrical portion constituting the tabular member are integrally formed and the number of steps for manufacturing molds that are used for molding the tabular member increases, in the present invention, since the partitions, the end spacers, and the connecting spacers having the relatively simple shapes are used, and hence the number of steps for manufacturing the molds which are used for molding these members can be reduced. Furthermore, as compared with the conventional permeable storage facility in which a cross-sectional area of the cylindrical portion is relatively smaller than a surface area of a flat plate of the tabular member and hence the flat plate deforms or strains to lower operating efficiency when an operator mounts a portion where a horizontal reinforcing material is not used in the flat plate at the time of assembling the permeable storage facility, in the present invention, since each partition is stably supported by each end spacer even if the operator mounts each horizontal connected unit at the time of assembling the storage composite, the operating efficiency can be improved, and using the connecting spacer having the smaller diameter than the large-diameter tube portion of each of the upper and lower end spacers enables reducing the number of starting materials for manufacturing the spacers.

In the storage composite according to the second aspect of the present invention, since each insertion hole is formed in the center of each of the plurality of partitions and the spindle pipe is vertically inserted into the insertion hole of each partition constituting each of the horizontal connected units on the plurality of levels, the spindle pipes, the partitions, the end spacers, and the connecting spacers receive a partial pressure in the vertical direction in external force acting on the storage composite, and the horizontal connected units on the upper and lower levels coupled and integrated through the spindle pipes receive a partial pressure in the horizontal direction in the external force acting on the storage composite. As a result, even if the storage composite formed by assembling the members having the relatively simple shapes is assembled so as to be larger than the storage composite according to the first aspect, especially assembled so as to be higher than a height of the storage composite according to the first aspect, strength as the structure can be assured.

In the storage composite according to the third aspect of the present invention, since the plurality of bottom plates are formed by forming flat lower surfaces of the plurality of partitions constituting the horizontal connected unit on the lowermost level and the plurality of top panels are formed by forming the flat upper surfaces of the plurality of partitions constituting the horizontal connected unit on the uppermost level, there is no cylindrical rib protruding on the lower surfaces of the bottom plates or no cylindrical rib protruding on the upper surfaces of the top panel in case of wrapping the storage composite with an impermeable sheet or a permeable sheet, and the impermeable sheet or the permeable sheet can be prevented from being damaged by edges of these ribs. Further, when the bottom plates and the top panels are molded into the same shape, the number of steps for manufacturing molds can be reduced, and the number of components can be decreased, thus facilitating component management.

In the storage composite according to the fourth aspect of the present invention, since each interval between the horizontal connected units on the plurality of levels in the vertical direction is configured to be larger on the upper side than the lower side, strength on the upper side can be lowered, and structural wastes can be excluded.

In the storage composite according to the fifth aspect of the present invention, the convex portion and the concave portion are provided on each of the four side surfaces of the partition, the convex portion of the partition engages with the concave portion of the partition adjacent to this partition, and the concave portion of the partition engages with the convex portion of the partition adjacent to this partition, whereby the partitions adjacent to each other can be prevented from being displaced in the vertical direction, thus further firmly connecting the partitions adjacent to each other. As a result, the horizontal connected units which are coupled with each other by aligning the plurality of partitions on the same horizontal plane can be structurally further strengthened. Further, as compared with the conventional permeable storage facility in which the flat plate of the tabular member falls to be deformed or damaged when an operator mounts the flat plate of the tabular member before setting the horizontally extending reinforcing material and tries to work at the time of assembling the permeable storage facility, in the present invention, each partition is stably supported by each end spacer and the partitions adjacent to each other are engaged through the convex portion and the concave portion even if an operator mounts the horizontal connected units at the time of assembling the storage composite, and hence the partitions adjacent to each other can be prevented from being displaced in the vertical direction. Moreover, since directivity of these partitions does not have to be considered at the time of coupling the respective partitions, and hence assembling operability of the storage composite is not spoiled.

In the storage composite according to the sixth or eighth aspect of the present invention, since the first and second convex portions and the first and second concave portions are arranged on the outer peripheral surface of the square tube rib in a reticular pattern by placing the first convex portion immediately below the second concave portion and placing the second convex portion immediately above the first concave portion, even if each partition is turned over or any one of the four outer peripheral surface of each partition is appressed against a partition adjacent to this partition, the first convex portion of the partition engages with the first or second concave portion of a partition adjacent to this partition, and the second convex portion of the partition engages with the second or first concave portion of a partition adjacent to this partition. As a result, each partition can be relatively easily laid out. Since it is possible to assuredly avoid the horizontal displacement of the adjacent partition in addition to the vertical displacement of the adjacent partition, the partitions which are adjacent to each other can be further firmly coupled. Further, since the end surfaces of the first and second convex portions protruding on the outer peripheral surfaces of the horizontal connected units coupled by aligning the plurality of partitions on the same horizontal plane are flat surfaces each having a relatively large surface, a member (e.g., a foam plate) inserted along the outer peripheral surface of each horizontal connected unit or a member (e.g., the impermeable sheet or the permeable sheet) facing the outer peripheral surface of each horizontal connected unit is not damaged.

In the storage composite according to the seventh aspect of the present invention, the horizontal connected units, which are configured by aligning and coupling the plurality of partitions on the same horizontal plate, are provided on the plurality of levels, the spacers are interposed between the horizontal connected units on the plurality of levels, and the spindle pipe is inserted into the insertion hole in each partition constituting each of the horizontal connected units on the plurality of levels along the vertical direction, whereby the spindle pipes and the spacers receive a partial pressure along the vertical direction in external force acting on the storage composite whilst the horizontal connected units on the upper and lower levels coupled and integrated through the spindle pipes receive a partial pressure in the horizontal direction in the external force acting on the storage composite. As a result, even the storage composite formed by assembling the members each having a relatively simple shape can assure strength of a relatively large structure. Furthermore, as compared with the conventional permeable storage facility in which each flat plate and each cylindrical portion constituting the tabular member are integrally formed, the tabular member has a relatively complicated shape, and hence the number of steps for manufacturing molds required for molding the tabular member increases, in the present invention, since the partitions and the spacers having the relatively simple shapes are used, the number of steps for manufacturing molds used for molding these members can be reduced. Additionally, the plurality of cylindrical ribs are protruded on the lower surfaces of the partitions concentrically with the insertion holes, the plurality of cylindrical ribs are protruded on the upper surfaces of the partitions concentrically with the insertion holes, and the spacers are connected to one or both of the upper surface and the lower surface of each partition so as to be movably inserted into any one of the plurality of ring grooves between the plurality of cylindrical ribs, waste pipes having different diameters can be used as the spacers as long as they are spacers that can be selectively movably inserted into any one of the plurality of ring grooves. As a result, the waste pipes having difficulty in disposal can be effectively used. Moreover, since the convex portion and the concave portion are provided on the four side surfaces of each partition in such a manner that the convex portion of the partition engages with the concave portion of the partition adjacent to this partition and the concave portion of the partition engages with the convex portion of the partition adjacent to each partition, the partitions adjacent to each other can be prevented from being displaced in the vertical direction, and the partitions adjacent to each other can be further firmly coupled. As a result, the horizontal connected units coupled with each other by aligning the plurality of partitions on the same horizontal plane can be structurally further reinforced. Additionally, as compared with the conventional permeable storage facility in which each flat plate of the tabular member falls to be deformed or damaged when an operator mounts the flat plate of the tabular member before setting the reinforcing material extending in the horizontal direction and tries to work at the time of assembling the permeable storage facility, in the present invention, since the partitions adjacent to each other engage with each other though the convex portion and the concave portion even if the operator mounts the horizontal connected units at the time of assembling the storage composite, the vertical displacement of the partitions adjacent to each other can be avoided. Further, since directivity of the respective partitions does not have to be considered at the time of coupling them, assembling operability of the storage composite is not spoiled.

Since the storage tank according to the ninth aspect of the present invention or the permeable storage tank according to the 11th aspect of the present invention is filled with the storage composite and the foam plates abut on the outermost surfaces of the plurality of end spacers placed on the outermost side in the plurality of end spacers of the storage composite filling such a tank so that the foam plates can surround the end spacers and the connecting spacers between the horizontal connected units on the plurality of levels, in case of wrapping the storage composite together with the foam plates with the impermeable sheet, even if a partial pressure in the horizontal direction in an external pressure acting on the storage composite acts on the impermeable sheet in a pressure-welding direction, the flat surfaces of the foam plates each having a large area receive this external pressure. As a result, the impermeable sheet can be prevented from being damaged.

Since the storage tank according to the 10th aspect of the present invention or the permeable storage tank according to the 12th aspect of the present invention is filled with the storage composite and the foam plates abut on the outermost surfaces of the plurality of end spacers placed on the outermost side in the plurality of end spacers of the storage composite filling such a tank so that the foam plates can surround the spacers between the horizontal connected units on the plurality of levels, in case of wrapping the storage composite together with the foam plates with the impermeable sheet, even if a partial pressure in the horizontal direction in an external pressure acting on the storage composite acts on the impermeable sheet in a pressure-welding direction, the flat surfaces of the foam plates each having a large area receive this external pressure. As a result, the impermeable sheet can be prevented from being damaged.

BRIEF DESCRIPTION OF DRAWINGS

FIG. 6 is an enlarged cross-sectional view of a portion D in FIG. 1;

FIG. 7 is a longitudinal cross-sectional view showing a state that bottom plates adjacent to each other are connected to each other through the first or second connecting member;

FIG. 8 is an enlarged cross-sectional view of a portion E in FIG. 1;

FIG. 9 is a longitudinal cross-sectional view showing a state that top panels adjacent to each other are connected to each other through the first or second connecting member;

MODE(S) FOR CARRYING OUT THE INVENTION

Modes for carrying out the present invention will now be described with reference to the drawings.

<First Embodiment>

Figure 1:
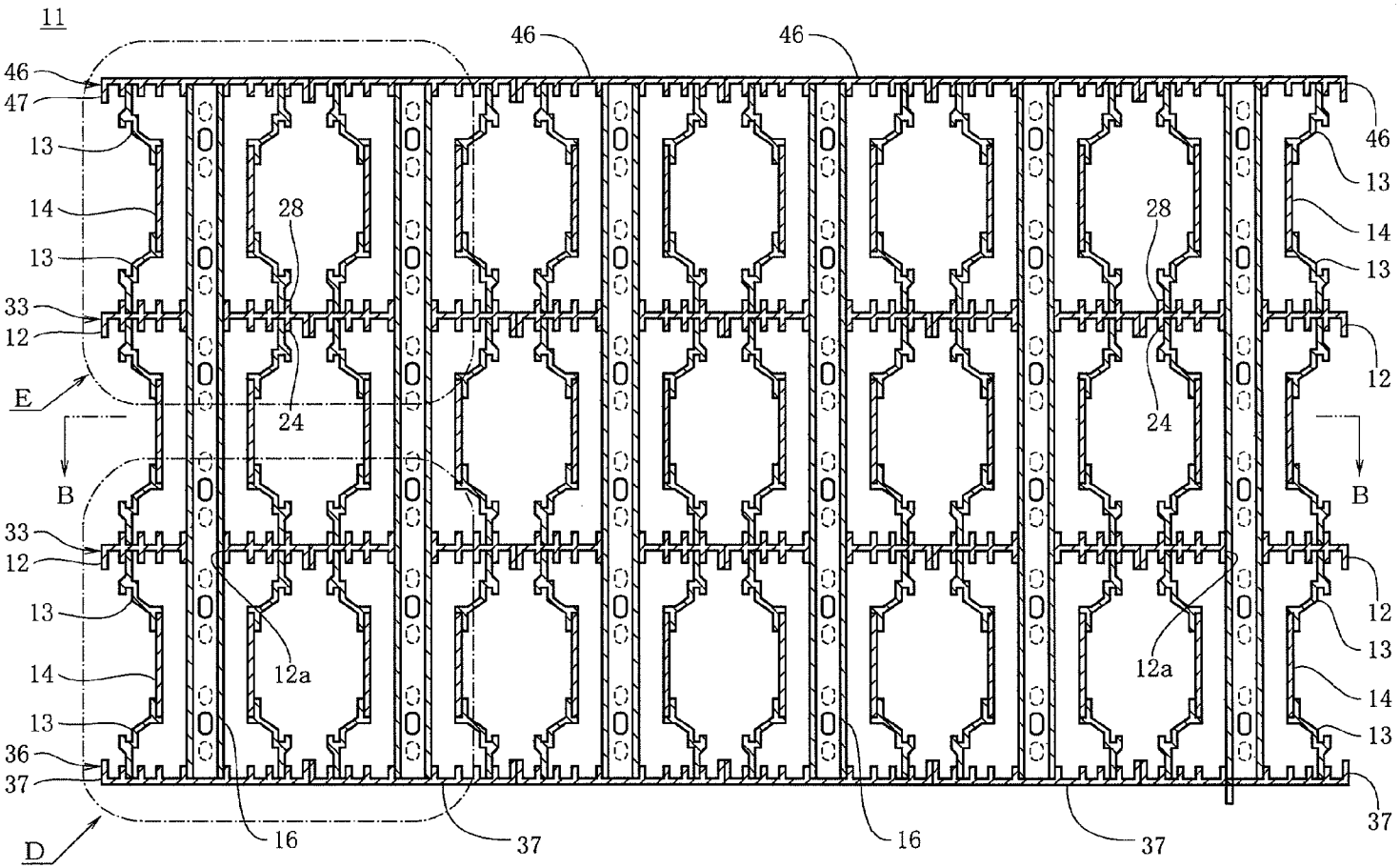
FIG. 1 is a cross-sectional view taken along a line A-A in FIG. 2 showing a state that a storage tank according to a first embodiment of the present invention is filled with storage composites.
Figure 2:
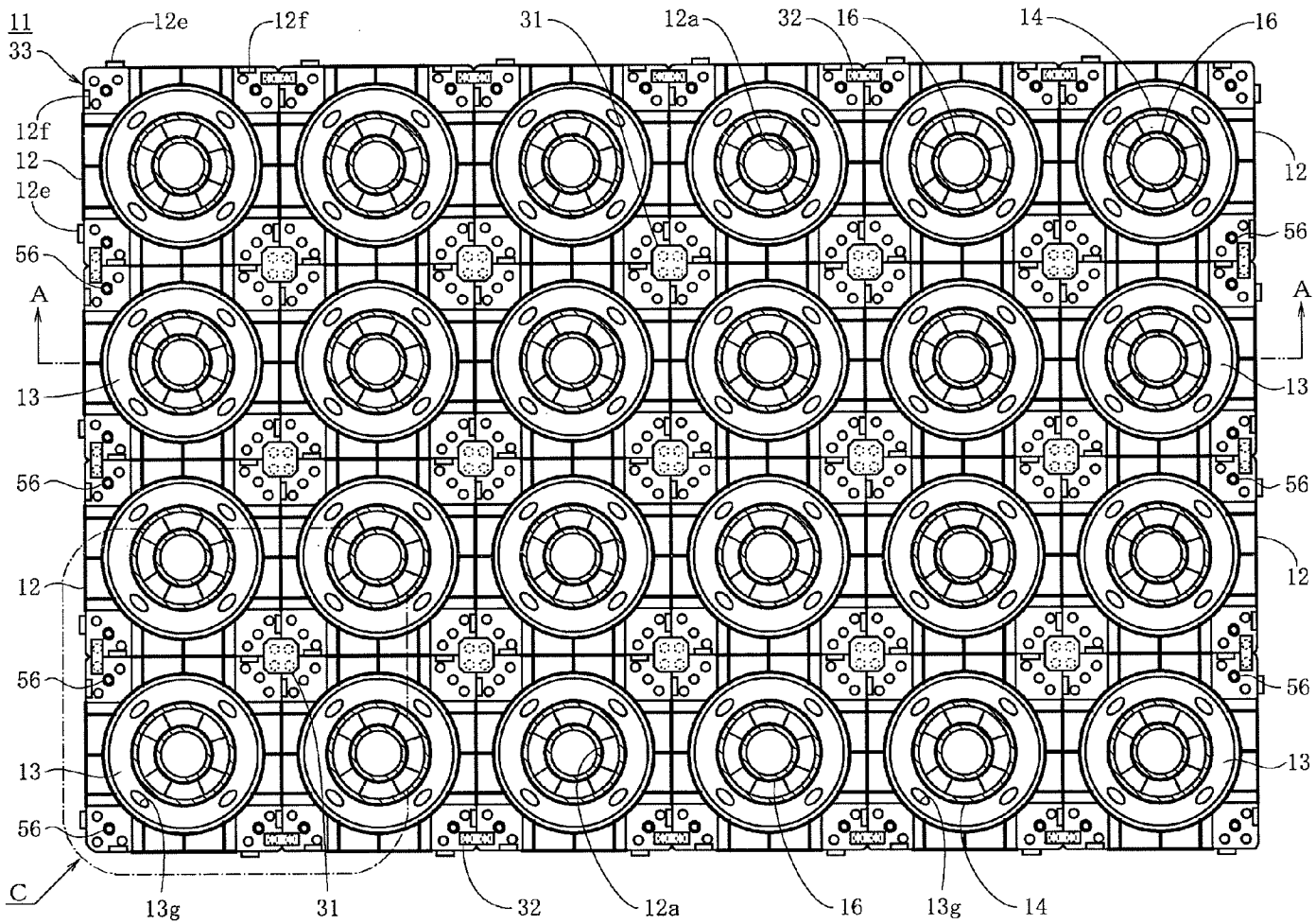
FIG. 2 is a cross-sectional view taken along a line B-B in FIG. 1 showing a state that the storage composites are aligned in a horizontal direction in the storage tank.

As shown in FIG. 1 and FIG. 2, a storage tank which stores rainwater and the like is filled with storage composites 11. The storage composite 11 includes: a plurality of partitions 12 each having at least one cylindrical rib 24 protruding on a lower surface thereof and at least one cylindrical rib 28 protruding on an upper surface thereof; a plurality of funnel-shaped end spacers 13 each having a large-diameter tube portion 13*a* that is fitted and connected to the cylindrical rib 24 on the lower surface and the cylindrical rib 28 on the upper surface of the partition 12 and a small-diameter tube portion 13*b* having a smaller diameter than this large-diameter tube portion 13*a*; and a plurality of cylindrical connecting spacers 14 each of which has both ends fitted to the small-diameter tube portions 13*b* and 13*b* of a pair of end spacers 13 and 13 facing each other and extends in a vertical direction.

As shown in FIG. 3, FIG. 6, FIG. 8, and FIG. 10 to FIG. 13, the partition 12 has a square-plate-like partition main body 12*b* having an insertion hole 12*a* formed at the center, a square-frame-like square tube rib 12*c* protruding downward over the entire outer periphery of this partition main body 12*b*, four first to fourth cylindrical ribs 21 to 24 protruding on a lower surface of the partition main body 12*b* in the same direction (downward) as the protruding direction of the square tube rib 12*c* concentrically with the insertion hole 12*a*, and four fifth to eighth cylindrical ribs 25 to 28 protruding on the upper surface of the partition main body 12*b* in the opposite direction (upward) of the protruding direction of the square tub rib 12*c* concentrically with the insertion hole 12*a*. The partition main body 12, the square tube rib 12*c*, and the first to eighth cylindrical ribs 21 to 28 are integrally molded by using plastic such as a polyolefin resin (polypropylene, polyethylene, or the like) or a vinyl chloride resin. Further, at least one cylindrical rib protruding on the lower surface of the partition 12 corresponds to the fourth cylindrical rib 24, and at least one cylindrical rib protruding on the upper surface of the partition 12 corresponds to the eighth cylindrical rib 28.

The square tube rib 12*c* of the partition 12 is formed with a height higher than those of the first to eighth cylindrical ribs 21 to 28 (FIG. 6, FIG. 8, and FIG. 10 to FIG. 13). Further, of the first to eighth cylindrical ribs 21 to 28, each of the first and fifth cylindrical ribs 21 and 25 is a cylindrical rib with a minimum diameter that is protruded on the entire peripheral edge of the insertion hole 12*a*. The second to fourth cylindrical ribs 22 to 24 are formed in such a manner that their diameters gradually increase from the second cylindrical rib 22 toward the fourth cylindrical rib 24, and the sixth to eighth cylindrical ribs 26 to 28 are formed in such a manner that their diameters gradually increase from the sixth cylindrical rib 26 toward the eighth cylindrical rib 28. Further, the first cylindrical rib 21 and the fifth cylindrical rib 25 have the same diameter, the second cylindrical rib 22 and the sixth cylindrical rib 26 have the same diameter, the third cylindrical rib 23 and the seventh cylindrical rib 27 have the same diameter, and the fourth cylindrical rib 24 and the eighth cylindrical rib 28 have the same diameter. Here, assuming that a length of one side of the partition 12 is S, a diameter T of a portion of each of the fourth and eighth cylindrical ribs 24 and 28 fitted to the large-diameter tube portion 13*a* of the end spacer 13 is set to fall within the range of 0.40S to 0.95S or preferably 0.75S to 0.90S. The diameter T is restricted to the range of 0.40S to 0.95S because each partition 12 cannot be stably supported by each end spacer 13 when an operator mounts a later-described horizontal connected unit 33 at the time of assembling the storage composite 11 in case of less than 0.40S and each of the fourth and eighth cylindrical ribs 24 and 28 protrudes toward the outside of the partition main body 12*b* and a gap is produced with respect to the adjacent partition 12 in case of greater than 0.95S. It is to be noted that a plurality of fan-shaped through holes 12*d* are formed between the respective cylindrical ribs 21 to 28 in the partition main body 12*b* (FIG. 3, FIG. 6, FIG. 8, and FIG. 10). These through holes 12*d* are formed so that rainwater or the like stored in a storage tank can circulate around the respective portions and generation of an air pocket in the storage tank can be avoided.

Figure 10:
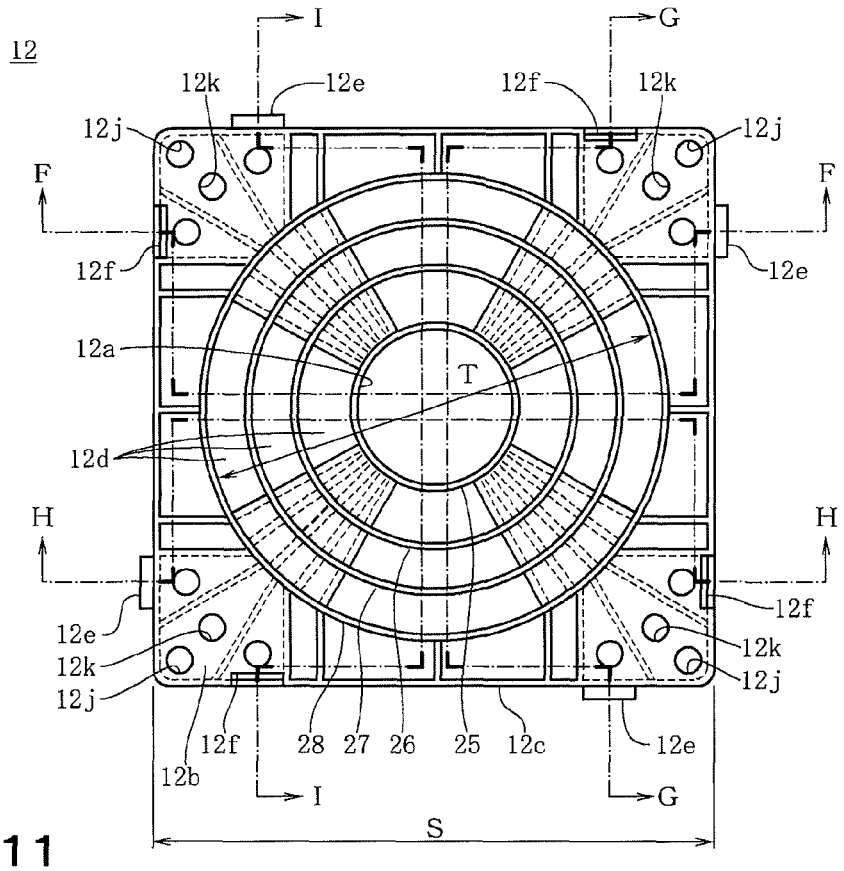
FIG. 10 is a plan view of the partition.
Figure 12:
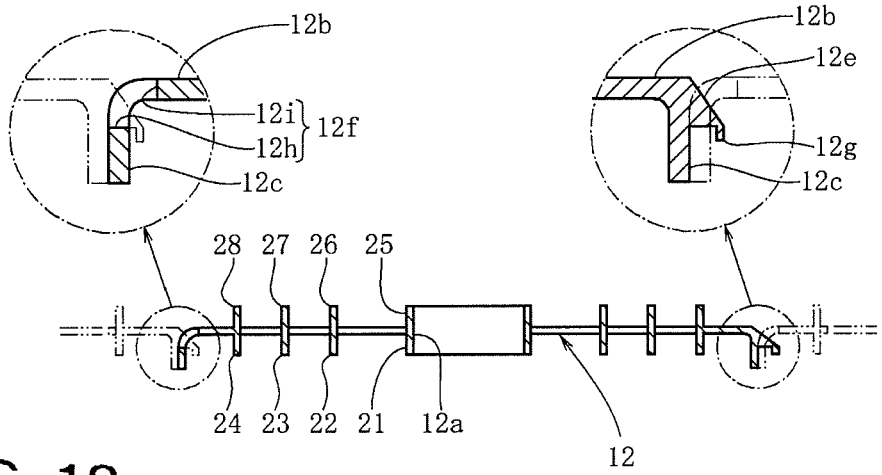
FIG. 12 is a cross-sectional view taken along a line F-F and a cross-sectional view taken along a line G-G in FIG. 10.
Figure 13:
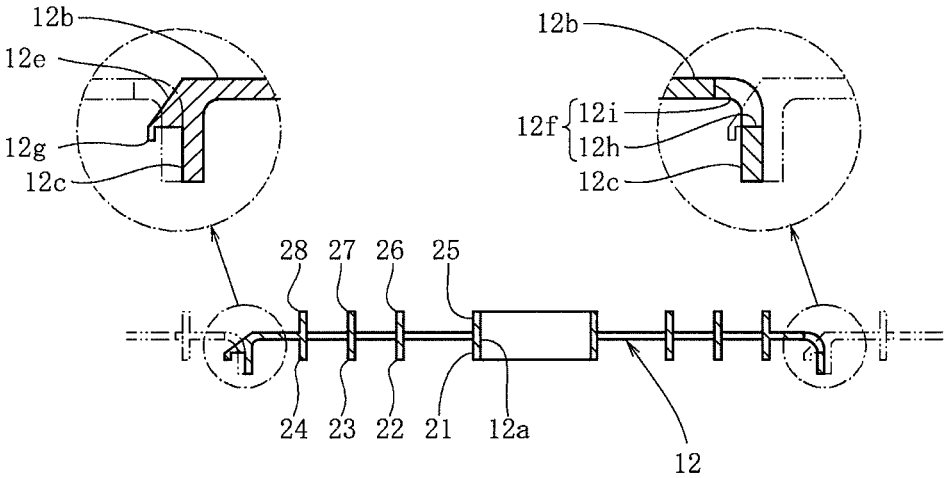
FIG. 13 is a cross-sectional view taken along a line H-H and a cross-sectional view taken along a line I-I in FIG. 10.
Figure 14:
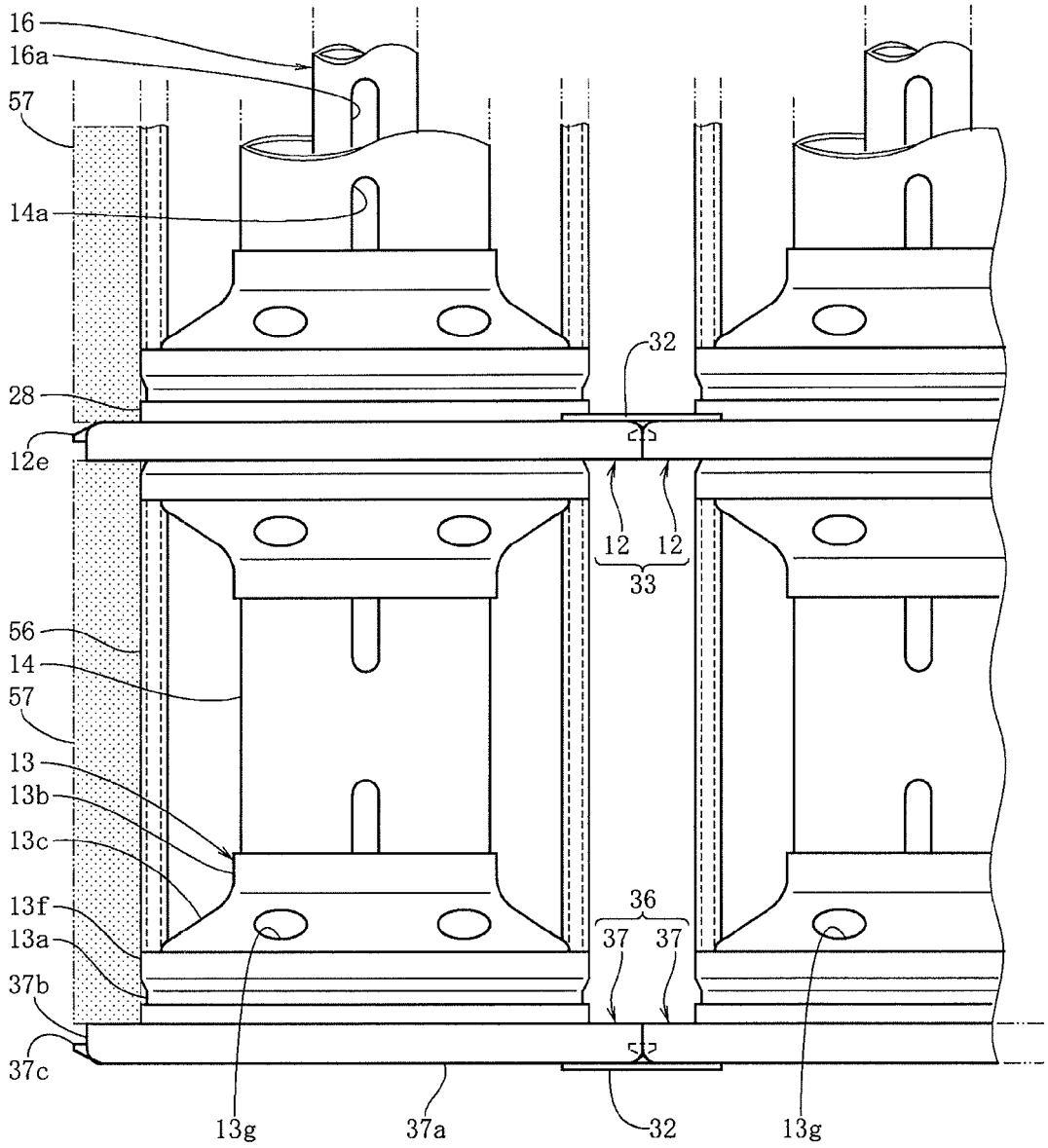
FIG. 14 is a side elevation of a primary part in the storage tank showing a state that foam plates abut on outer side surfaces of each end spacer placed on the outermost side of the storage composite.

Convex portions 12*e* and concave portions 12*f* are provided on four side surfaces of the partition 12 at predetermined intervals (FIG. 10, FIG. 12, and FIG. 13). Specifically, when each side surface is placed on the upper side in a planar view of the partition 12, the convex portion 12*e* is provided on the left side of the side surface placed on the upper side, and the concave portion 12*f* is provided on the right side of the same (FIG. 10). That is, the convex portion 12*e* and the concave portion 12*f* are provided on each of the four side surface of the partition 12 so as to be point-symmetrical with a hole core of the insertion hole 12*a* at the center. Furthermore, a longitudinal cross-sectional shape of the convex portion 12*e* in a protruding direction is substantially a right-triangular shape having an inclined surface inclined downward as distanced from the side surface of the partition 12 and a lower surface horizontally extending from the side surface of the partition 12, and a protrusion 12*g* extending downward along an end edge of the lower surface is provided at this end edge (FIG. 12 and FIG. 13). Moreover, the concave portion 12*f* has a vertical concave portion 12*j* formed by notching an upper portion of the square tube rib 12*c* and a horizontal concave portion 12*i* formed by notching a side portion of the partition main body 12*b* so as to be continuous with this vertical concave portion 12*h*. As a result, the convex portion 12*e* on one side surface of the partition 12 engages with the concave portion 12*f* on one side surface of the partition 12 adjacent to the one side surface of this partition 12, and the concave portion 12*f* on one side surface of the partition 12 engages with the convex portion 12*e* on one side surface of the partition 12 adjacent to this partition 12. It is to be noted that, in this embodiment, when each side surface is placed on the upper side in a planar view of the partition, the convex portion is provided on the left side of the side surface placed on the upper side and the concave portion is provided on the right side of the same, but the concave portion may be provided on the left side of the side surface placed on the upper side and the convex portion may be provided on the right side of the same.

Figure 3:
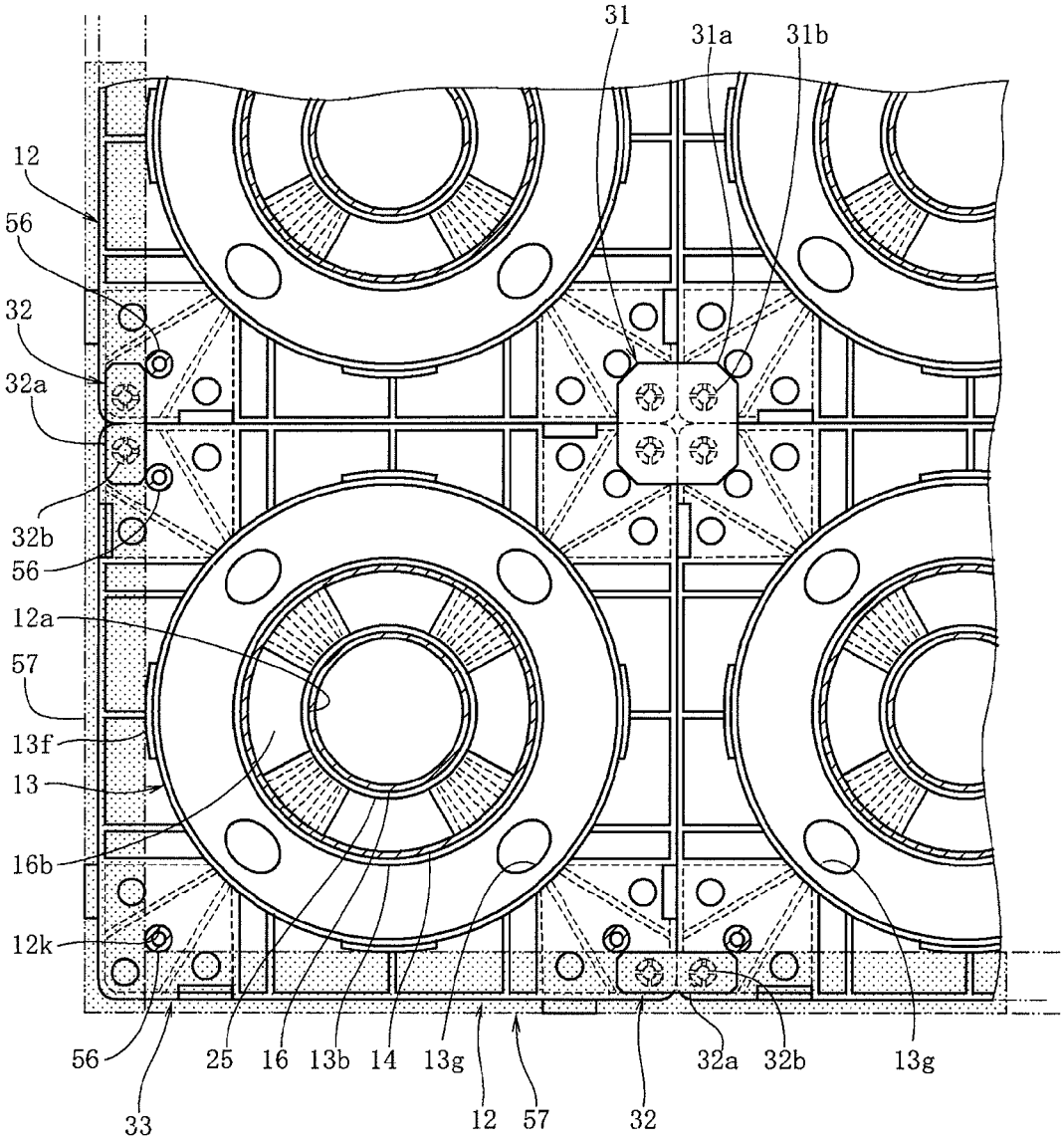
FIG. 3 is an enlarged cross-sectional view of a portion C in FIG. 2.

On the other hand, the large-diameter tube portion 13*a* and the small-diameter tube portion 13*b* of the end spacer 13 are connected through a taper tube portion 13*c*, and a stopper ring 13*d* is protruded on an inner surface of a connecting portion for the small-diameter tube portion 13*b* and the taper tube portion 13*c* (FIG. 6 and FIG. 8). The large-diameter tube portion 13*a* is fitted when it is inserted into the fourth cylindrical rib 24 or the eighth cylindrical rib 28 of the partition 12. Additionally, a ring-like step portion 13*e* is formed on an outer surface of a connecting portion for the large-diameter tube portion 13*a* and the taper tube portion 13*c*, and four arc-shaped receiving ribs 13*f* are protruded on an outer peripheral edge of the step portion 13*e* toward the small-diameter tube portion 13*b* side at equal intervals, i.e., intervals of 90 degrees (FIG. 3, FIG. 6, and FIG. 8). An outer surface of each of these receiving ribs 13*f* is protruded slightly outward from the outer surface of the large-diameter tube portion 13*a*, and the outer surface of each receiving rib 13*f* is configured to receive a later-described foam plate 57. The large-diameter tube portion 13*a* of another end spacer 13 can be movably inserted into the ring-like step portion 13*e*. As a result, at the time of conveying the plurality of end spacers 13 as components, when the large-diameter tube portion 13*a* of the end spacer 13 is movably inserted into the ring-like step portion 13*e* of another end spacer 13 and the plurality of end spacers 13 are stacked, a space occupied by the end spacers 13 during the conveyance is reduced, and conveyance efficiency can be improved. Further, the large-diameter tube portion 13*a*, the small-diameter tube portion 13*b*, the taper tube portion 13*c*, the stopper ring 13*d*, the step portion 13*e*, and the receiving rib 13*f* are integrally molded with use of plastic, e.g., a polyolefin resin (polypropylene, polyethylene, or the like) or a vinyl chloride resin. It is to be noted that reference sign 13*g* in FIG. 3 denotes an elliptic hole formed in the taper tube portion 13*c*. This elliptic hole 13*g* is formed in order to rapidly lead rainwater or the like stored in the storage tank into the end spacer 13 and thereby avoid generation of an air pocket in the end spacer 13. Furthermore, in this embodiment, the four receiving ribs are formed on the outer peripheral edge of the step portion of the end spacer at equal intervals, but ring-like receiving ribs may be protruded on the entire outer peripheral edge of the step portion of the end spacer.

The connecting spacer 14 is formed by cutting a commercially available plastic pipe such as a VU pipe (a sewerage hard vinyl chloride pipe on which an inner pressure does not act) to a predetermined length (FIG. 1, FIG. 6, and FIG. 8). This connecting spacer 14 is fitted when inserted into the small-diameter tube portion 13*b* of the end spacer 13. An end surface of the connecting spacer 14 inserted into the small-diameter tube portion 13*b* of the end spacer 13 is configured to abut on the stopper ring 13*d*. Further, each slot 14*a* extending in the vertical direction is formed in the connecting spacer 14. This slot 14*a* is formed to avoid generation of an air pocket in the connecting spacer 14 by rapidly introducing rainwater or the like stored in the storage tank into the connecting spacer 14. It is to be noted that, if structural strength is required for the connecting spacer, a plastic pipe such as VP pipe (a waterworks hard vinyl chloride pipe on which an inner pressure acts) can be used in place of the VU pipe. The VP pipe is formed with a larger wall thickness than that of the VU pipe.

A spindle pipe 16 is vertically inserted into the insertion hole 12*a* of the partition 12. This spindle pipe 16 is made of plastic such as polyvinyl chloride (PVC) or polypropylene (PP). An outer diameter of the spindle pipe 16 is formed to be slightly smaller than a diameter of the insertion hole 12*a* of the partition 12 (FIG. 3, FIG. 6, and FIG. 8). As a result, the spindle pipe 16 can be smoothly inserted into the insertion hole 12*a*. Furthermore, a plurality of slots 16*a* extending in the longitudinal direction of the spindle pipe 16 are formed in an outer peripheral surface of the spindle pipe 16 at predetermined intervals (FIG. 6 and FIG. 8). These slots 16*a* are formed to prevent generation of an air pocket in the spindle pipe 16 by introducing rainwater or the like stored in the storage tank into the spindle pipe 16. Moreover, a length of the spindle pipe 16 extends from a bottom surface to an upper surface of the storage tank (FIG. 1). When a depth of the storage tank is larger than the length of the spindle pipe 16, a pipe connector (not shown) is used for connection. It is to be noted that, when the storage tank is relatively small and relatively small strength alone is required, the spindle pipe may be omitted.

Figure 4:
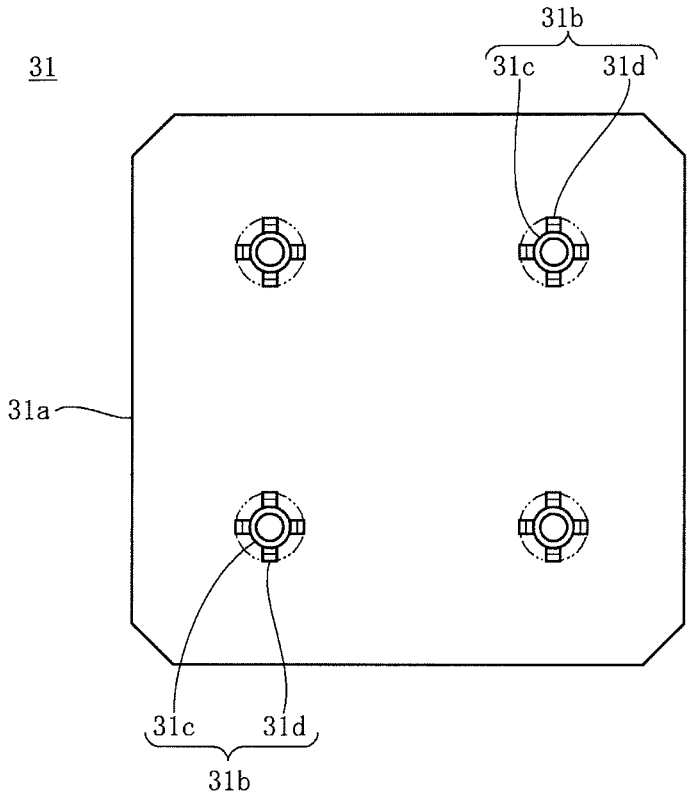
FIG. 4 is a plan view of a first connecting member that connects respective corner portions of four partitions which are adjacent to each other on the same horizontal plane of the storage composite.
Figure 5:
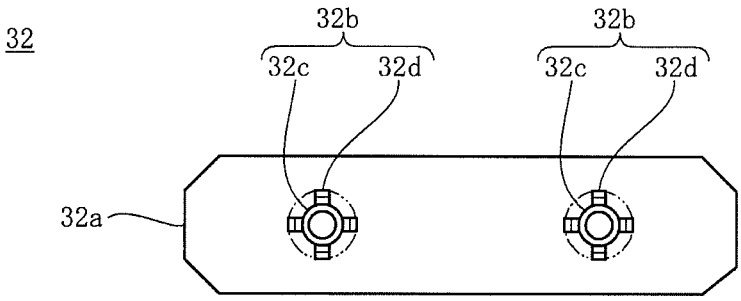
FIG. 5 is a plane view of a second connecting member that connects respective corner portions of two partitions which are placed on the outermost sides and adjacent to each other on the same horizontal plane of the storage composite.
Figure 11:
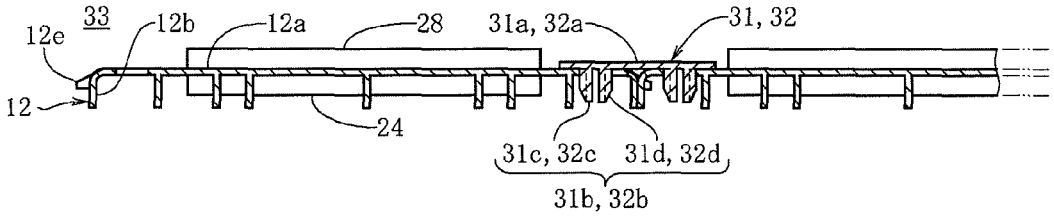
FIG. 11 is a longitudinal cross-sectional view showing a state that the partitions adjacent to each other are connected to each other through the first or second connecting member.

When the plurality of partitions 12 are aligned on the same horizontal plane and coupled with each other through the first or second connecting members 31 or 32, a horizontal connected unit 33 is configured (FIG. 2 to FIG. 5 and FIG. 11). That is, respective corner portions of the four partitions 12 which are adjacent to each other on the same horizontal surface of the storage composite 11 are coupled with each other through the first connecting members 31, and respective corner portions of the two partitions 12 which are placed on the outermost side on the same horizontal plane of the storage composite 11 and adjacent to each other are coupled with each other through the second coupling members 32, thereby configuring the horizontal connected unit 33. The first connecting member 31 has a first connecting main body 31*a* formed into a square plate shape and a first engagement protrusion 31*b* protruded on each of the four corner portions on one surface of the first connecting main body 31*a*. The first engagement protrusion 31*b* is constituted of a cylindrical protrusion main body 31*c* and four engagement ribs 31*d* provided on the outer peripheral surface of the protrusion main body 31*c* in the circumferential direction at predetermined intervals (FIG. 4 and FIG. 11). Each of these engagement ribs 31*d* is formed into a taper shape that a protruding height from the outer peripheral surface of the protrusion main body 31*c* gradually decreases as getting closer to the distal end from the proximal end of the protrusion main body 31*c*. Engagement holes 12*j* facing the first engagement protrusions 31*b* are formed at four corner portions of the partition main body 12*b* of the partition 12, respectively. A diameter of a virtual circle (a circle indicated by a two-dot chain line in FIG. 4) connecting the outer surfaces of each of the four engagement ribs 31*d* provided at the periphery of the protrusion main body 31*c* of the first engagement protrusion 31*b* is formed to be larger than a diameter of the engagement hole 12*j* on the proximal end side of the first engagement protrusion 31*b*, and it is formed to be smaller than a diameter of the engagement hole 12*j* on the distal end side of the first engagement protrusion 31*b*. As a result, when the distal end portion of the first engagement protrusion 31*b* smaller than the diameter of the virtual circle is inserted into each engagement hole 12*j* so that each first engagement protrusion 31*b* can be put into each engagement hole 12*j*, the proximal end portion of each first engagement protrusion 31*b* having the large diameter of the virtual circle engages with each engagement hole 12*j* in an interference fit state, and each first engagement protrusion 31*b* cannot be removed from each engagement hole 12*j*. On the other hand, the second coupling member 32*b* has a second connecting main body 32*a* having a rectangular plate shape relatively largely chamfered on two corner portions and two second engagement protrusions 32*b* protruded on two corner portions on one surface of the second connecting main body 32*a* (FIG. 5 and FIG. 11). The second engagement protrusion 32*b* is constituted of a protrusion main body 32*c* and an engagement rib 32*d* and formed into the same shape as the first engagement protrusion 31*b*. The first and second connecting members 31 and 32 are molded by using plastic such as a polyolefin resin (polypropylene, polyethylene, or the like) or a vinyl chloride resin. It is to be noted that the horizontal connected units 33 are provided on a plurality of levels.

On the other hand, a plurality of bottom plates 37 are formed when lower surfaces of the plurality of partition constituting the horizontal connected unit 36 on the lowermost level are formed flat, and a plurality of top panels 47 are formed when upper surfaces of the plurality of partitions constituting the horizontal connected unit on the uppermost level are formed flat (FIG. 1, and FIG. 6 to FIG. 9). The first to fourth cylindrical ribs 21 to 24 protruded on the lower surface of the partition main body 12*b* in a state that the partition 12 is turned over and installed so that the square tube rib 12 can extend upwardly are not formed on the bottom plate 37, and the insertion hole 12*a* and the fan-shaped through holes 12*d* are not formed either. That is, the bottom plate 37 has a bottom plate main body 37*a* having a square plate shape formed into the same shape as the partition main body 12*b*, a bottom plate square tube rib 37*b* having a square frame shape protruded upward along an outer peripheral surface of the bottom plate main body 37*a*, and first to fourth bottom plate cylindrical ribs 41 to 44 which are concentrically formed (FIG. 1, FIG. 6, and FIG. 7). Further, convex portions 37*c* and concave portions (not shown) are provided on four side surfaces of the bottom plate like the partition 12, and engagement holes 37*e* (FIG. 7) are formed at four corner portions of the bottom plate 37, respectively. Furthermore, the convex portions 37*c* and the concave portions of the bottom plates 37 which are adjacent to each other are engaged like the partitions 12 which are adjacent to each other, and these bottom plates 37 are connected through the first or second connecting member 31 or 32. As a result, the plurality of bottom plates 37 are laid out on the bottom surface of the storage tank, thereby constituting the horizontal connected body 36 on the lowermost level.

The fifth to eighth cylindrical ribs 25 to 28 which are protruded on the upper surface of the partition main body 12*b* in a state that the square tube rib 12*c* is installed to extend downward are not formed on the top panel 47, and the insertion hole 12*a* and the fan-shaped through holes 12*d* are not formed either. That is, the top panel 47 has a top panel main body 47*a* having a square plate shape formed into the same shape as the partition main body 12*b*, a top panel square tube rib 47*b* having a square frame shape protruded downward along an outer peripheral surface of the top panel main body 47*a*, and first to fourth top panel cylindrical ribs 51 to 54 which are concentrically formed (FIG. 1, FIG. 8, and FIG. 9). Moreover, like the partition 12, convex portions 47*c* and concave portions (not shown) are provided on four side surfaces of the top panel 47 like the partition 12, and engagement holes 47*e* (FIG. 9) are formed at four corner portions of the top panel 47, respectively. Additionally, like the partitions 12 that are adjacent to each other, the convex portions 47*c* and the concave portions of the top panels 47 that are adjacent to each other are engaged, and these top panels 47 are connected through the first or second connecting member 31 or 32. As a result, the plurality of top panels 47 are arranged on the upper surface of the storage tank in close contact, thus configuring the horizontal connected unit 46 on the uppermost level. The bottom plates 37 and the top panels 47 are formed into the same shape by using plastic such as a polyolefin resin (polypropylene, polyethylene, or the like) or vinyl chloride resin. As a result, the number of steps for manufacturing molds of the bottom plates 37 and the top panels 47 can be reduced, the number of components can be decreased, and component management can be facilitated. It is to be noted that reference sign 12*k* in FIG. 3 and FIG. 10 denotes a through hole formed on the inner side of a locking hole 12*j* in each of the four corner portions of the partition 12. A small-diameter receiving pipe 56 is inserted into the through hole 12*k* placed on the outermost side of the partition 12 placed on the outermost side of the horizontal connected unit 33. This receiving pipe 56 is formed of, e.g., a vinyl chloride pipe, and it is configured to receive a later-described foam plate 57 with the receiving rib 13*b* of the end spacer 13. Additionally, the receiving pipe 56 is formed with the same length as the spindle pipe 16.

A procedure for assembling the thus configured storage composite 11 and putting into the storage tank will now be described. First, the ground is drilled into a rectangular parallelepiped shape having a predetermined depth, a bottom surface of this drilled portion is compacted with gravel or sand, and then an impermeable sheet is spread so as to cover the bottom surface and a side surface of this drilled portion. In this state, the bottom plates 37 are aligned and laid on the bottom surface of the drilled portion from corners of the drilled portion through the impermeable sheet, the convex portions 37*c* and the concave portions of the bottom plates 37 adjacent to each other are engaged, the respective corners portions of the four bottom plates 37 adjacent to each other are coupled through the first connecting members 31, and the respective corner portions of the two bottom plates 37 which are placed on the outermost side and adjacent to each other are coupled through the second connecting members 32. As a result, the horizontal connected unit 36 on the lowest level is formed. Further, at the time of engaging the convex portions 37*c* and the concave portions of the bottom plates 37 adjacent to each other, directivity of each bottom plate 37 does not have to be taken into consideration, and hence assembling operability of the storage composite 11 is not spoiled.

Then, the large-diameter tube portion 13*a* of each end spacer 13 is inserted into the fourth bottom plate cylindrical rib 44 of each bottom plate 37 constituting the horizontal connected unit 36 on the lowest level, a lower end of each connecting spacer 14 is inserted into the small-diameter tube portion 13*b* of this end spacer 13, the small-diameter tube portion 13*b* of a newly prepared end spacer 13 is fitted on the upper end of this connecting spacer 14, and then the fourth cylindrical rib 24 of a newly prepared partition 12 is fitted into the large-diameter tube portion 13*a* of this end spacer 13. Furthermore, the convex portions 12*e* and the concave portions 12*f* of the partitions 12 that are adjacent to each other are engaged with each other, the respective corner portions of the four partitions 12 that are adjacent to each other are coupled through the first connecting members 31, and the respective corner portions of the two partitions 12 that are placed on the outermost side and adjacent to each other are coupled through the second coupling members 32. As a result, the horizontal connected unit 33 on the second level from the bottom is formed. Here, at the time of engaging the convex portions 12*e* and the concave portions 12*f* of the partitions 12 that are adjacent to each other, directivity of each partition 12 does not have to be taken into consideration, and hence assembling operability of the storage composite 11 is not spoiled. In this state, each spindle pipe 16 is inserted into the insertion hole 12*a* of each partition 12, and then the lower end of the spindle pipe 16 is inserted into the first bottom plate cylindrical rib 41 on each bottom plate 37, whereby the spindle pipe 16 is erected. At this time, since the lower end of each spindle pipe 16 abuts on the bottom plate main body 37*a* of each bottom plate 37, contact of the spindle pipe 16 with respect to the impermeable sheet can be avoided. As a result, the permeable sheet can be prevented from being damaged by the edge of each spindle pipe 16. Moreover, the small-diameter receiving pipe 56 is inserted into the through hole 12*k* of placed on the outermost side in each partition 12 placed on the outermost side of the horizontal connected unit 33 on the second level from the bottom.

As described above, since the convex portion 12*e* of each partition 12 engages with the concave portion 12*f* of the partition 12 adjacent to each partition 12 and the concave portion 12*f* of each partition 12 engages with the convex portion 12*e* of the partition 12 adjacent to this partition 12, the adjacent partition 12 can be prevented from being displaced in the vertical direction, and the partitions 12 that are adjacent to each other can be firmly coupled. As a result, the horizontal connected unit 33 obtained by aligning the plurality of partitions 12 on the same horizontal plane and coupling them can be further structurally strengthened. Additionally, even if an operator mounts the horizontal connected unit 33 on the second level from the bottom, each partition 12 is stably supported by each end spacer 13, and the partitions 12 that are adjacent to each other are engaged with each other through the convex portions 12*e* and the concave portions 12*f*, and hence the partitions L that are adjacent to each other can be assuredly prevented from being displaced in the vertical direction. Further, since the upper and lower end spacers 13 are connected by using the connecting spacer 14 having a smaller diameter than the large-diameter tube portion 13*a* of each of these end spacers 13, starting materials used for manufacturing the spacers 13 and 14 can be reduced.

Then, the large-diameter tube portion 13*a* of a newly prepared end spacer 13 is inserted into the eighth cylindrical rib 28 of each partition 12 constituting the horizontal connected unit 33 on the second level from the bottom, a lower end of the newly prepared connecting spacer 14 is inserted into the small-diameter tube portion 13*b* of this end spacer 13, a small-diameter tube portion 13*b* of the newly prepared end spacer 13 is fitted to the upper end of this connecting spacer 14, and thereafter a fourth cylindrical rib 24 of the newly prepared partition 12 is fitted into the large-diameter tube portion 13*a* of this end spacer 13. At this time, the insertion hole 12*a* of each partition 12 is fitted to the spindle pipe 16, and the through hole 12*k* of each partition 12 is fitted to the small-diameter receiving pipe. Furthermore, the convex portions 12*e* and the concave portions 12*f* of the partitions 12 that are adjacent to each other are engaged, the respective corner portions of the four partitions 12 that are adjacent to each other are coupled through the first connecting members 31, and the respective corner portions of the two partitions 12 that are placed on the outermost side and adjacent to each other are coupled through the second coupling members 32. As a result, the horizontal connected unit 33 on the third level from the bottom is formed.

Subsequently, the large-diameter tube portion 13*a* of a newly prepared end spacer 13 is inserted into the eighth cylindrical rib 28 of each partition 12 constituting the horizontal connected unit 33 on the third level from the bottom, a lower end of the newly prepared connecting spacer 14 is inserted into the small-diameter tube portion 13*b* of this end spacer 13, a small-diameter tube portion 13*b* of the newly prepared end spacer 13 is fitted to the upper end of this connecting spacer 147, and thereafter the fourth top plate cylindrical rib 54 of each top panel 47 is fitted to the large-diameter tube portion 13*a* of this end spacer 13. At this time, the first top panel cylindrical rib 51 of each top panel 47 is fitted in the spindle pipe 16. Furthermore, the convex portions 47*c* and the concave portions of the top panels 47 that are adjacent to each other are engaged, the respective corner portions of the four top panels 47 that are adjacent to each other are coupled through the first connecting members 31, and the respective corner portions of the two top panels 12 that are placed on the outermost side and adjacent to each other are coupled through the second connecting members 32. As a result, the horizontal connected unit 46 on the highest level is formed. In this manner, the drilled portion is filled with the storage composite 11.

Moreover, the foam plates 57 having a relatively small expansion ratio that is twentyfold to thirtyfold and having relatively high toughness are prepared. Additionally, the foam plates 57 are arranged to abut on the outermost surfaces of the receiving ribs 13*f* of the plurality of end spacers 13 placed on the outermost side of the plurality of end spacers 13 and outer surfaces of the small-diameter receiving pipes 56 in the storage composites 11 filling the drilled portion. As a result, the plurality of foam plates 57 surround the end spacers 13 and the coupling spacers 14 between the horizontal connected unit 36 on the lowest level and the horizontal connected unit 33 on the second level from the bottom, surround the end spacers 13 and the connecting spacers 14 between the horizontal connected unit 36 on the lowest level and the horizontal connected unit 33 on the second level from the bottom, surround the end spacers 13 and the connecting spacers 14 between the horizontal connected unit 33 on the second level from the bottom and the horizontal connected unit 33 on the third level from the bottom, and surround the end spacers 13 and the connecting spacers 14 between the horizontal connected unit 33 on the third level from the bottom and the horizontal connected unit 46 on the highest level. Here, if the foam plates 57 may possibly fall, temporarily fixing them by an adhesive tap is preferable. In this state, an outer peripheral portion of the impermeable sheet is mounted and laminated on the upper surface of the storage composite 11, whereby the storage composite 11 are wrapped together with the foam plates 57 with the impermeable sheet. At this time, since the upper end of each spindle pipe 16 abuts on the top panel main body 47*a* of each top panel 47, contact of each spindle pipe 16 with respect to the impermeable sheet can be avoided. As a result, the permeable sheet can be prevented from being damaged by the edge of each spindle pipe 16. Additionally, a gap between the side surface of the drilled portion and the impermeable sheet is filled with sand or soil.

In the storage composite 11 filling the storage tank in this manner, the horizontal connected units 36, 33, 33, and 46 configured by aligning the plurality of partitions 12 on the same horizontal plane and connecting them are provided on the plurality of levels (four levels), the end spacers 13 and the connecting spacers 14 are interposed between the horizontal connected units 36, 33, 33, and 46 on the plurality of levels, and each spindle pipe 16 is vertically inserted into the insertion hole 12*a* of each partition 12 constituting each of the horizontal connected units 33 and 33 on the plurality of levels, and hence each spindle pipe 16, each end spacer 13, and each connecting spacer 14 receive a partial pressure along the vertical direction in external force acting on the storage composite 11 whilst the horizontal connected units 33, 33, and 46 mainly receive a partial pressure along the horizontal direction in the external force acting on the storage composite 11. As a result, even the storage composite 11 formed by assembling the members having relatively simple shapes can assure strength as a relatively large structure. Further, since the partitions 12, the end spacers 13, and the connecting spacers 14 having the relatively simple shapes are used, the number of steps for manufacturing molds that are used to mold these members can be reduced. Furthermore, since the storage composite 11 is wrapped together with the foam plates 57 with the impermeable sheet, even if the partial pressure along the horizontal direction in the external force acting on the storage composite 11 acts on the impermeable sheet in a pressure-welding direction, the large-area flat surface of each foam plate 57 receives this external pressure. As a result, the impermeable sheet can be prevented from being damaged.

<Second Embodiment>

Figure 15:
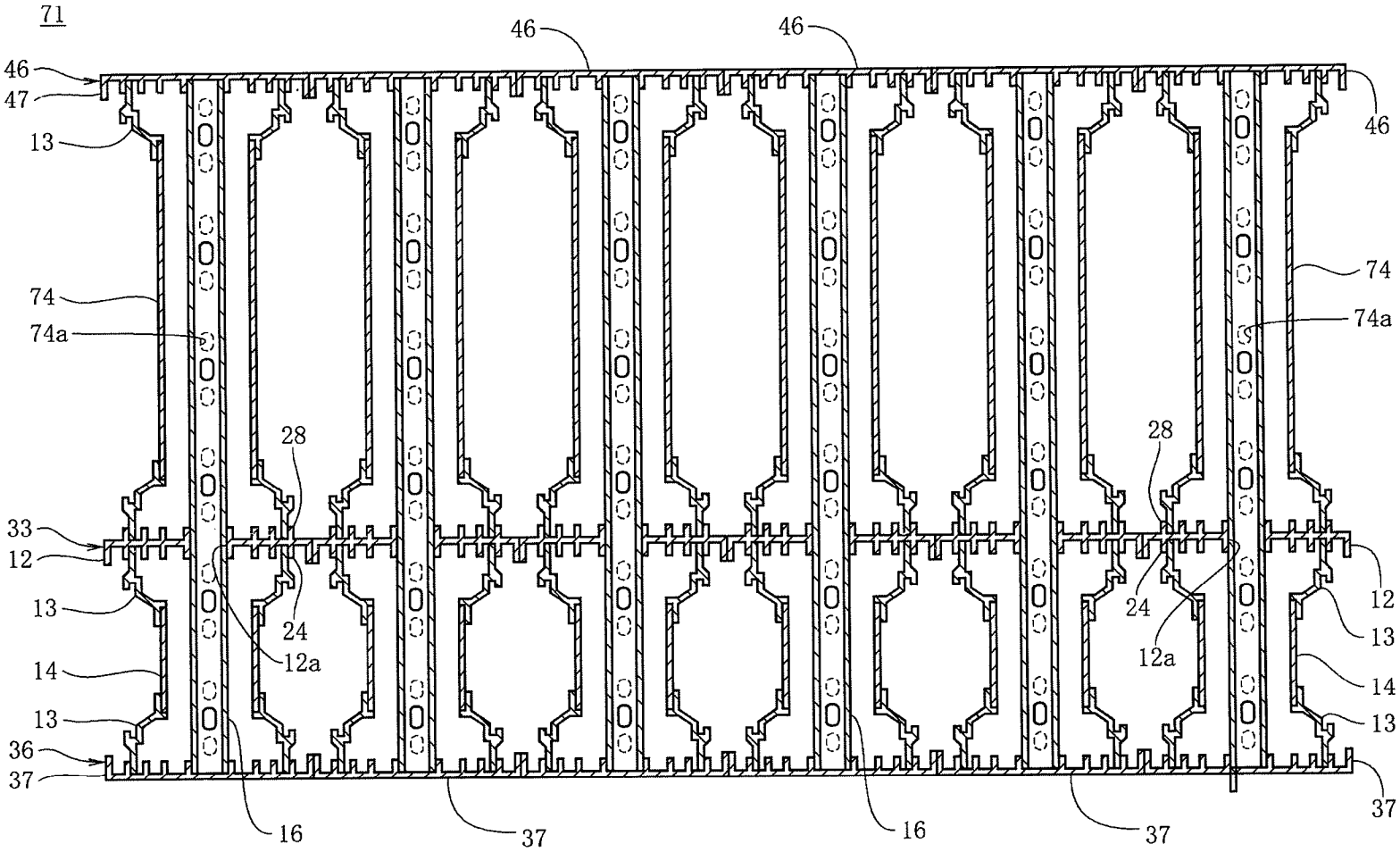
FIG. 15 is a cross-sectional view associated with FIG. 1, showing a state that storage tank according to a second embodiment of the present invention is filled with storage composites.

FIG. 15 shows a second embodiment according to the present invention. In FIG. 15, like reference numerals denote the same components as those in FIG. 1. In this embodiment, horizontal connected units 36, 33, and 46 on a plurality of levels are configured so as to have a larger vertical interval on the upper side than on the lower side. That is, the horizontal connected unit 33 on the third level from the bottom according to the first embodiment is omitted. Moreover, in place of the end spacers 13 and 13 connected with the lower surface and the upper surface of the horizontal connected unit 33 on the third level from the bottom and the connecting spacers 14 connected to these end spacers 13 and 13 according to the first embodiment, each elongated connecting spacer 74 is used. A lower end of this elongated connecting spacer 74 is inserted into a small-diameter tube portion 13*b* of an end spacer 13 connected with an upper surface of a partition 12 constituting a horizontal connected unit 33 on the second level from the bottom, and an upper end of the elongated connecting spacer 74 is inserted into the small-diameter tube portion 13*b* of the end spacer 13 connected with a lower surface of a top panel 47 constituting a horizontal connected unit 46 on the highest level. Additionally, a plurality of slots 74*a* are formed in each elongated connecting spacer 74. These slots 74*a* are formed to prevent an air pocket from being generated in the elongated connecting spacer 74 by introducing rainwater or the like stored in a storage tank into the elongated connecting spacer 74. Other structures are configured in the same manner as the first embodiment.

In a storage composite 71 configured in this manner, since the horizontal connected units 36, 33 and 46 on the plurality of levels are configured to have a larger vertical interval on the upper side than on the lower side, strength on the upper side can be reduced, and structural wastes can be omitted. Operations and effects other than those described above are substantially the same as those of the first embodiment, and hence an overlapping description will be omitted.

<Third Embodiment>

FIG. 16 to FIG. 20 show a third embodiment according to the present invention. In FIG. 16 to FIG. 20, like reference numerals denote the same components as those in FIG. 1 to FIG. 14. In this embodiment, in place of the end spacers 13 and the connecting spacers 14 according to the first embodiment, each cylindrical spacer 93 is used. Further, partitions 12, spindle pipes 16, bottom plates 37, top panels 47, first connecting members 31, second connecting members 32, a horizontal connected unit 33, a horizontal connected unit 36 on the lowest level, a horizontal connected unit 46 on the highest level, and receiving pipes 56 are formed into the same shapes as those in the first embodiment. Specifically, a storage composite 91 has the plurality of square-plate-like partitions 12 each having an insertion hole 12*a* at the center, the plurality of cylindrical spacers 93 connected to lower surfaces and upper surfaces of the partitions 12, and the spindle pipes 16 inserted into the insertion holes 12*a* of the partitions 12. First to fourth cylindrical ribs 21 to 24 are protruded on the lower surface of each partition 12 concentrically with the insertion hole 12, and fifth to eighth cylindrical ribs 25 to 28 are protruded on the upper surface of each partition 12 concentrically with the insertion hole 12*a*.

Figure 16:
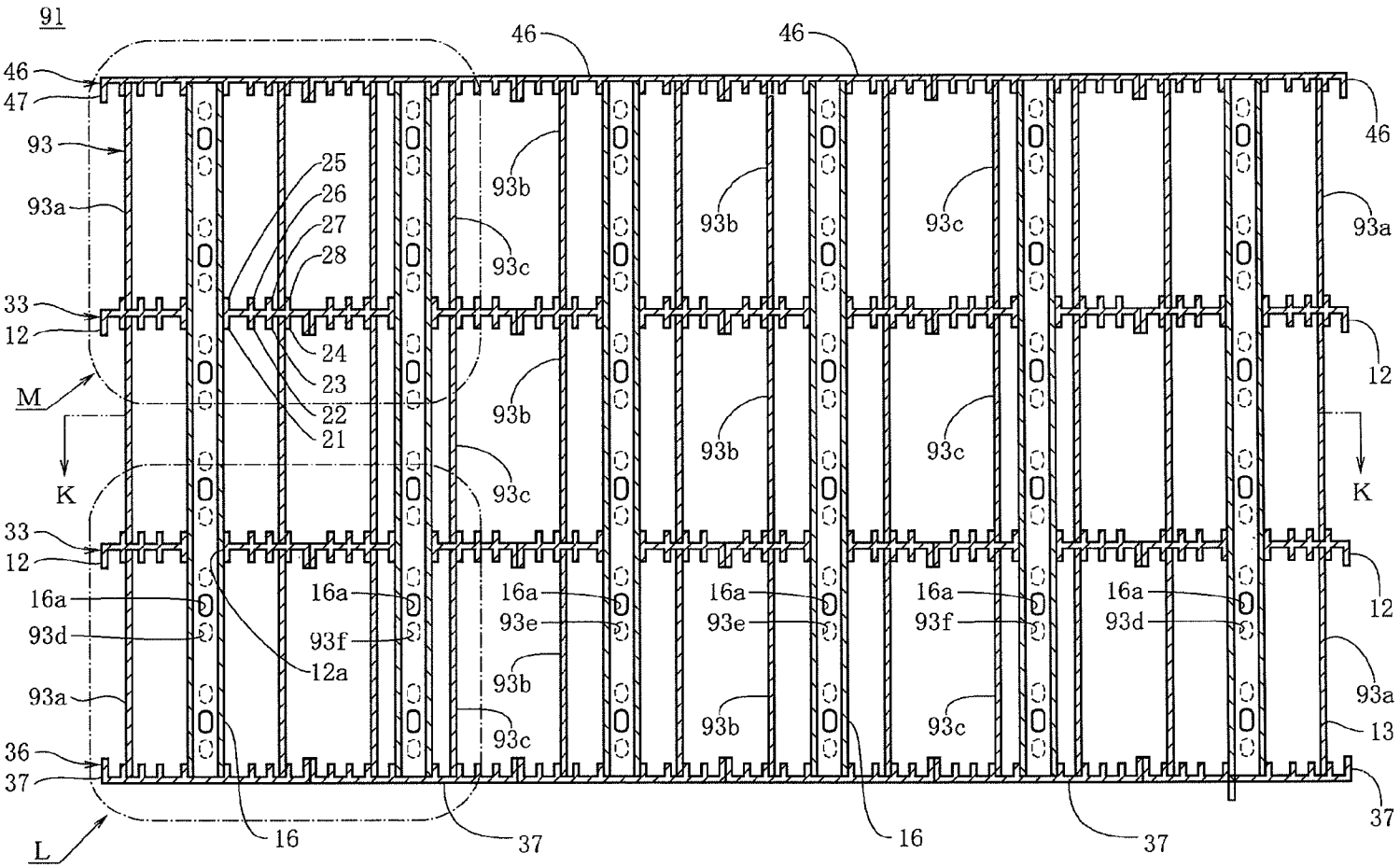
FIG. 16 is a cross-sectional view taken along a line J-J in FIG. 17, showing a state that a storage tank according to a third embodiment of the present invention is filled with storage composites.
Figure 17:
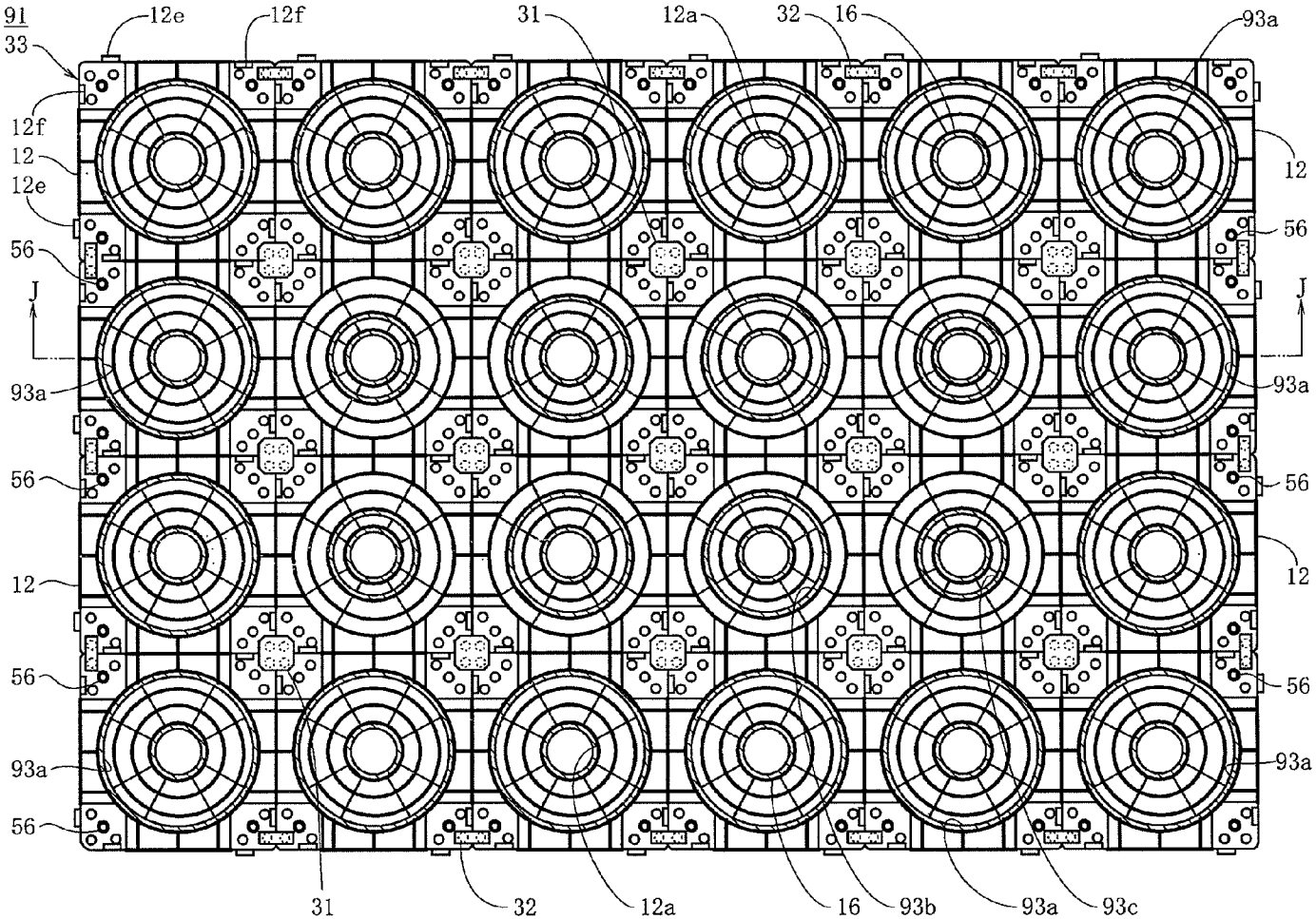
FIG. 17 is a cross-sectional view taken along a line K-K in FIG. 16, showing a state that the storage composites are aligned in the horizontal direction in the storage tank.
Figure 18:
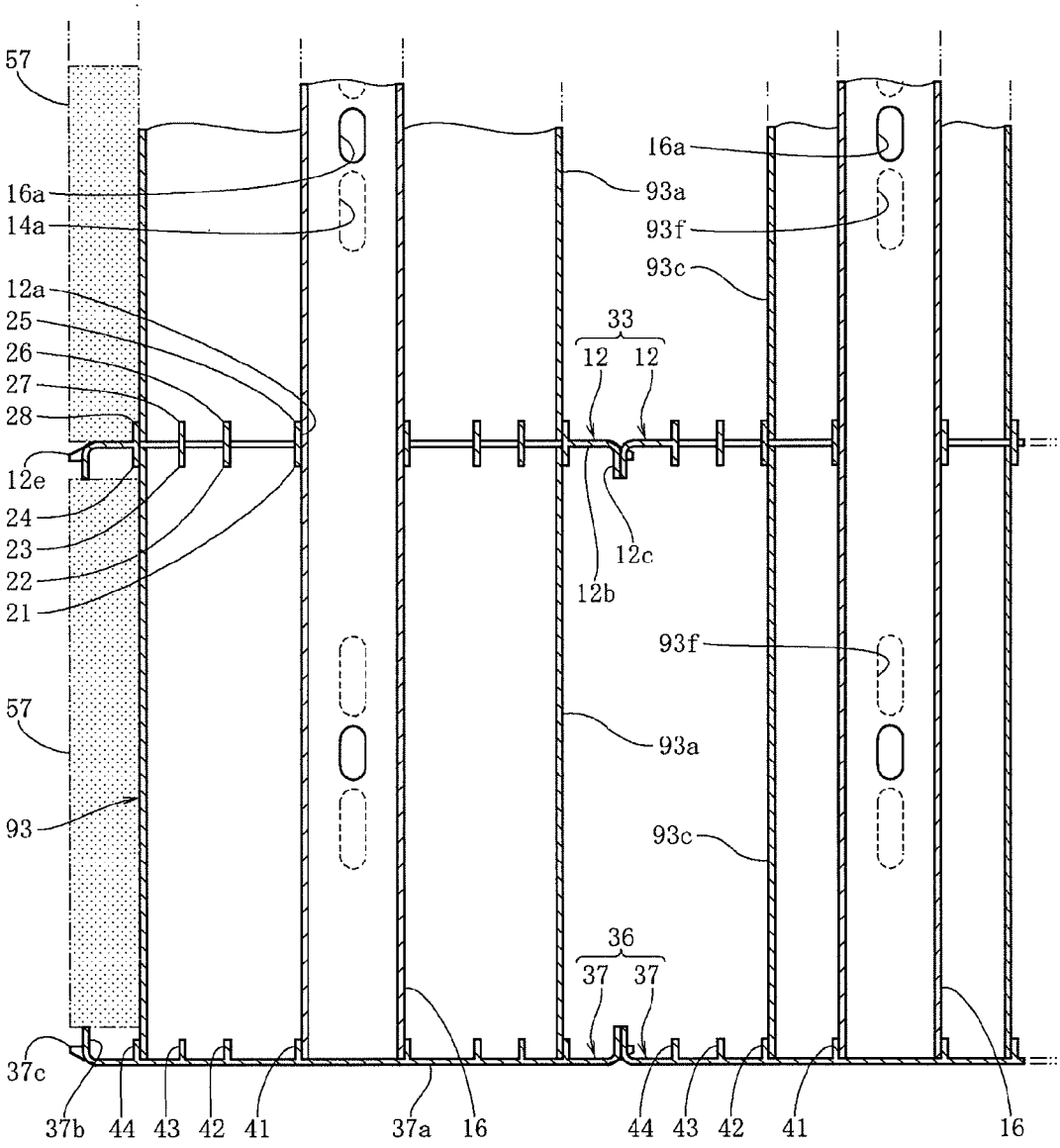
FIG. 18 is an enlarged cross-sectional view of a portion L in FIG. 16.
Figure 19:
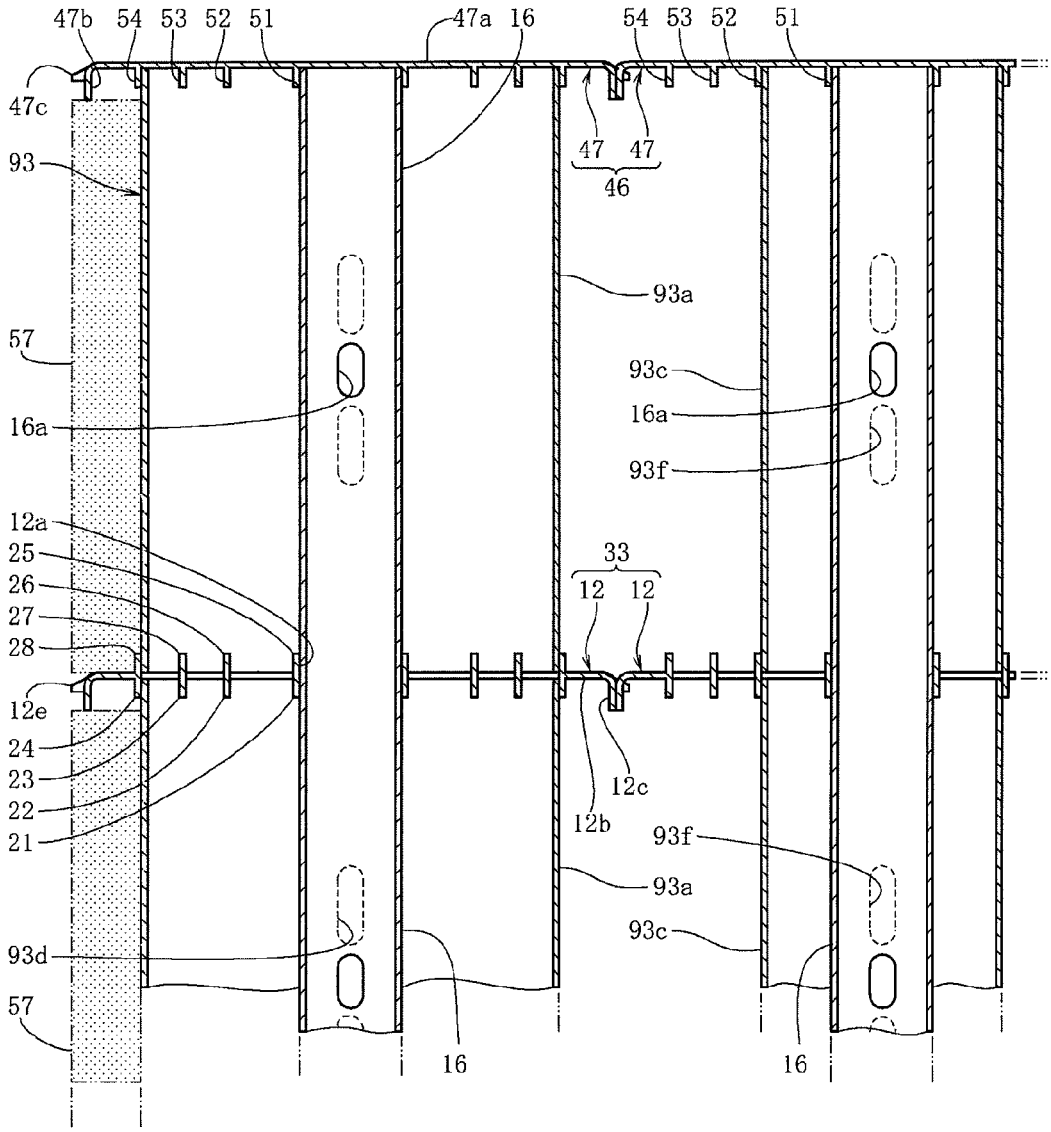
FIG. 19 is an enlarged cross-sectional view of a portion M in FIG. 16.
Figure 20:
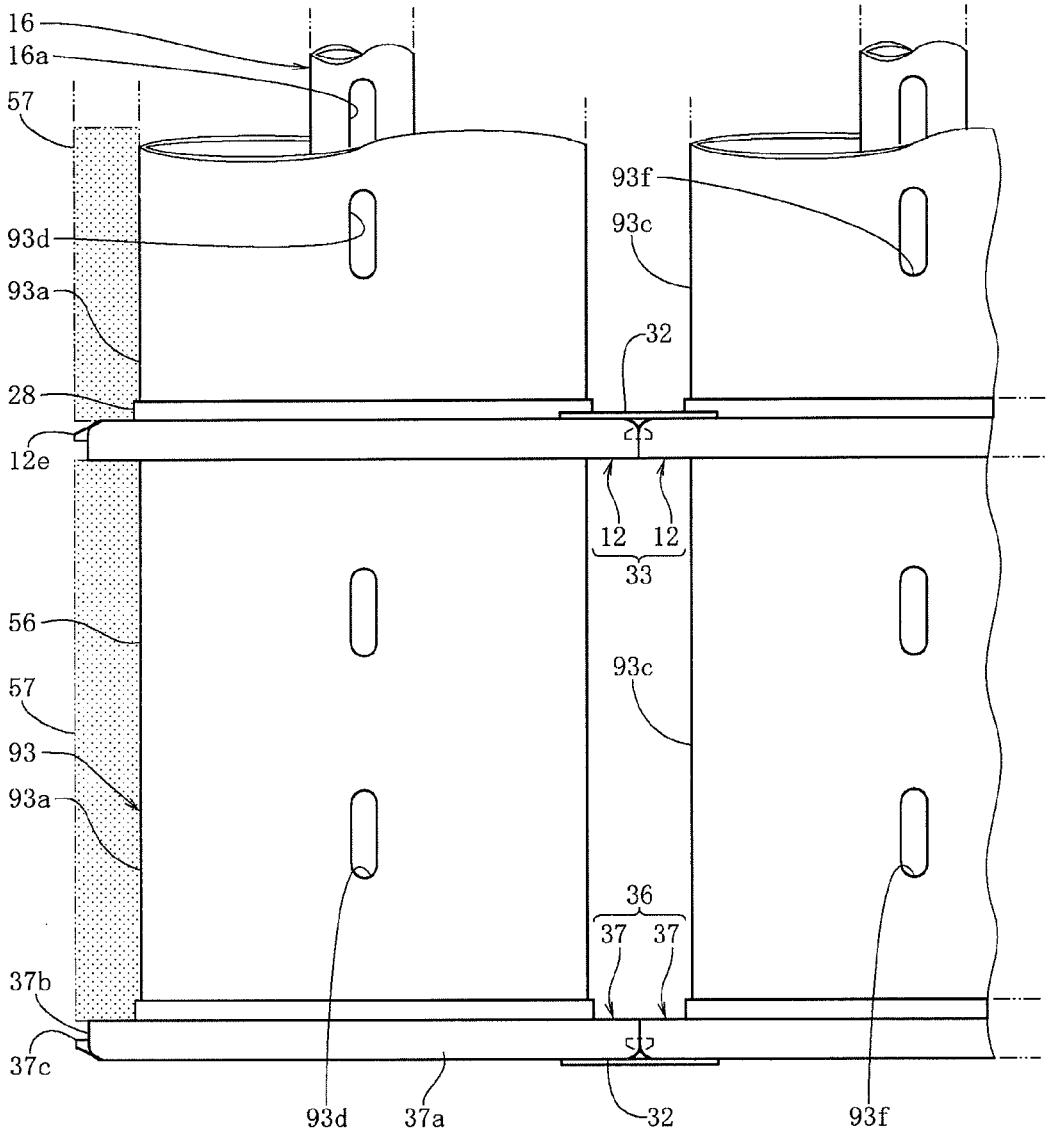
FIG. 20 is a side elevation of a primary part in the storage tank, showing a state that a foam plate abuts on an outer side surface of a spacer placed on the outermost side of the storage composite.

Furthermore, as the spacers 93, three types of first to third spacers 93*a* to 93*c* having different diameters are used (FIG. 16 and FIG. 17). The thickest first spacer 93*a* is movably inserted into a ring groove between the third cylindrical rib 23 and the fourth cylindrical rib 24 on a lower surface of each partition 12, movably inserted into a ring groove between the seventh cylindrical rib 27 and the eighth cylindrical rib 28 on an upper surface of each partition 12, movably inserted into a ring groove between a third bottom plate cylindrical rib 43 and a fourth bottom plate cylindrical rib 44 on an upper surface of each bottom plate 37, or movably inserted into a ring groove between a third top panel cylindrical rib 53 and a fourth top panel cylindrical rib 54 on a lower surface of each top panel 47. Furthermore, the second spacer 93*b* having the second thickness is movably inserted into a ring groove between the second cylindrical rib 22 and the third cylindrical rib 23 on the lower surface of each partition 12, movably inserted into a ring groove between the sixth cylindrical rib 26 and the seventh cylindrical rib 27 on the upper surface of each partition 12, movably inserted into a ring groove between a second bottom plate cylindrical rib 42 and the third bottom plate cylindrical rib 43 on the upper surface of each bottom plate 37, or movably inserted into a ring groove between a second top panel cylindrical rib 52 and the third top panel cylindrical rib 53 on the lower surface of each top panel 47. Moreover, the thinnest third spacer 93*c* is movably inserted into a ring groove between the first cylindrical rib 21 and the second cylindrical rib 22 on the lower surface of each partition 12, movably inserted into a ring groove between the fifth cylindrical rib 25 and the sixth cylindrical rib 26 on the upper surface of each partition, movably inserted into a ring groove between a first bottom plate cylindrical rib 41 and the second bottom plate cylindrical rib 42 on the upper surface of each bottom plate 37, or movably inserted into a ring groove between a first top panel cylindrical rib 51 and the second top panel cylindrical rib 52 on the lower surface of the top panel 47. That is, each spacer 13 is connected to the upper surface or the lower surface of each partition 12 so as to be movably inserted into one of the plurality of ring grooves between the plurality of cylindrical ribs 21 to 28, connected to the upper surface of each bottom plate 37 so as to be movably inserted into one of the plurality of ring grooves between the plurality of bottom plate cylindrical ribs 41 to 44, or connected to the lower surface of each top panel 47 so as to be movably inserted into one of the plurality of ring grooves between the plurality of top panel cylindrical ribs 51 to 54.

Although the thickest first spacer 93*a* is interposed between the bottom plate 37 and the partition 12, between the partition 12 and the partition 12, or between the partition 12 and the top panel 47 that are placed on the outermost side of each of the plurality of horizontal connected units 36, 33, 33, and 46 on the four levels, one of the second and third spacers 93*b* and 93*c* is interposed at any other position. Additionally, a plurality of slots 93*d* to 93*f* extending in the vertical direction are formed in the first to third spacers 93*a* to 93*c*, respectively (FIG. 16 and FIG. 18 to FIG. 20). These slots 93*d* to 93*f* are formed to prevent an air pocket from being generated in the first to third spacers 93*a* to 93*c* by rapidly introducing rainwater or the like stored in a storage tank into the first to third spacers 93*a* to 93*c*. It is to be noted that although the three types of cylindrical spacers having the different diameters are used in this embodiment, two types of spacers having different diameters or one type of cylindrical spacer may be used, a circular truncated conical spacer having different diameters at an upper end and a lower end may be used. Other structures are configured in the same manner as the first embodiment.

A procedure for assembling a storage composite 91 configured in this manner and filling the storage tank with this storage composite 11 will now be described. First, the ground is drilled into a rectangular parallelepiped shape having a predetermined depth, a bottom surface of this drilled portion is compacted with gravel or sand, and then an impermeable sheet is spread so as to cover the bottom surface and a side surface of this drilled portion. In this state, bottom plates 37 are aligned and laid on the bottom surface of the drilled portion from corners of the drilled portion through the impermeable sheet, convex portions 37*c* and concave portions (not shown) of the bottom plates 37 adjacent to each other are engaged, the respective corner portions of the four bottom plates 37 adjacent to each other are coupled through first connecting members 31, and the respective corner portions of the two bottom plates 37 which are placed on the outermost side and adjacent to each other are coupled through second connecting members 32. As a result, the horizontal connected unit 36 on the lowest level is formed. Further, at the time of engaging the convex portions 37*c* and the concave portions of the bottom plates 37 adjacent to each other, directivity of each bottom plate 37 does not have to be taken into consideration, and hence assembling operability of the storage composite is not spoiled.

Then, the thickest first spacer 93*a* is movably inserted into the ring groove between the third and fourth bottom plate cylindrical ribs 43 and 44 of each bottom plate 37 placed on the outermost side of the horizontal connected unit 36 on the lowest level, one of the second and third spacers 93*b* and 93*c* is movably inserted into one of the three ring grooves between the first to fourth bottom plate cylindrical ribs 41 to 44 on each bottom plate 37 placed at any other position, and then one of the three ring grooves between the first to fourth cylindrical ribs 21 to 24 on each partition 12 is movably fitted on the upper end of each of these spacers 93*a* to 93*c*. Moreover, the convex portions 12*e* and the concave portions 12*f* of the partitions 12 that are adjacent to each other are engaged, the respective corner portions of the four partitions 12 that are adjacent to each other are coupled through the first connecting members 31, and the respective corner portions of the two partitions 12 that are placed on the outermost side and adjacent to each other are coupled through the second connecting members 32. As a result, the horizontal connected unit 33 on the second level from the bottom is formed. Here, at the time of engaging the convex portions 12*e* and the concave portions 12*f* of the partitions 12 that are adjacent to each other, since directivity of each partition 12 does not have to be taken into consideration, assembling operability of the storage composite 91 is not spoiled. In this state, each spindle pipe 16 is inserted into the insertion hole 12*a* of each partition 12, and then the lower end of each spindle pipe 16 is inserted into the first bottom plate cylindrical rib 41 on each bottom plate 37, whereby each spindle pipe 16 is erected. At this time, since the lower end of the spindle pipe 16 abuts on the bottom plate main body 37*a* of the bottom plate 37, contact of the spindle pipe 16 with respect to the impermeable sheet can be avoided. As a result, a permeable sheet can be prevented from being damaged by an edge of each spindle pipe 16. Further, a small-diameter receiving pipe 56 having the same length as the spindle pipe 16 is inserted into a through hole 12*k* placed on the outermost side of each partition 12 placed on the outermost side of the horizontal connected unit 33 on the second level from the bottom.

As described above, since the convex portion 12*e* of each partition 12 engages with the concave portion 12*f* of the partition 12 adjacent to this partition 12 and the concave portion 12*f* of the partition 12 engages with the convex portion 12*e* of the partition 12 adjacent to this partition 12, the adjacent partition 12 can be prevented from being displaced in the vertical direction, and the partitions 12 adjacent to each other can be firmly coupled. As a result, each horizontal connected unit 33 obtained by aligning the plurality of partitions 12 on the same horizontal plane and coupling them can be further structurally strengthened. Furthermore, since the partitions 12 that are adjacent to each other are engaged through the convex portions 12*e* and the concave portions 12*f*, the partitions 12 adjacent to each other can be assuredly prevented from being displaced in the vertical direction. Moreover, when waste pipes are used as the first to third spacers 93*a* to 93*c*, the waste pipes having difficulty in disposal can be effectively used.

Then, each of newly prepared first to third spacers 93*a* to 93*c* is movably inserted into one of the three ring grooves between the firth to eighth cylindrical ribs 25 to 28 of each partition 12 constituting the horizontal connected unit 33 on the second level from the bottom. At this time, the thickest first spacer 93*a* is movably inserted between the third and fourth bottom plate cylindrical ribs 23 and 24 of the partition 12 placed on the outermost side of the horizontal connected unit 33 on the second level from the bottom. One of the three ring grooves between the first to fourth cylindrical ribs 21 to 24 of the newly prepared partition 12 is movably fitted to the upper end of each of the first to third spacers 93*a* to 93*c*. At this time, the insertion hole 12*a* of partition 12 is fitted with respect to the spindle pipe 16, and the through hole 12*k* of the partition 12 is fitted with respect to the small-diameter receiving pipe 56. Moreover, the convex portions 12*e* and the concave portions 12*f* of the partitions 12 adjacent to each other are engaged, and the respective corner portions of the four partitions 12 adjacent to each other are coupled through the first connecting members 31, and the respective corner portions of the two partitions 12 that are placed on the outermost side and adjacent to each other are coupled through the second connecting members 32. As a result, the horizontal connected unit 33 on the third level from the bottom is formed.

Subsequently, each of the newly prepared first to third spacers 93*a* to 93*c* is movably inserted into one of the three ring grooves between the fifth to eighth cylindrical ribs 25 to 28 of each partition constituting the horizontal connected unit 33 on the third level from the bottom. At this time, the thickest first spacer 93*a* is movably inserted between the third and fourth bottom plate cylindrical ribs 23 and 24 of the partition placed on the outermost side of the horizontal connected unit 33 on the third level from the bottom. Each of the three ring grooves between the first to fourth top panel cylindrical ribs 53 to 54 of each top panel 47 is movably fitted on the upper end of each of the first to third spacers 93*a* to 93*c*. At this time, the first top panel cylindrical rib 51 of each top panel 47 is fitted in the spindle pipe 16. Additionally, the convex portions 47*c* and the concave portions (not shown) of the top panels 47 which are adjacent to each other are engaged, the respective corner portions of the four top panels 47 that are adjacent to each other are coupled through the first connecting members 31, and the respective corner portions of the two top panels 12 that are placed on the outermost side and adjacent to each other are coupled through the second connecting members 32. As a result, the horizontal connected unit 46 on the highest level is formed. In this manner, the drilled portion is filled with the storage composite 91.

Further, the foam plates 57 having a relatively small expansion ratio that is twentyfold to thirtyfold and having relatively high toughness are prepared. Additionally, the foam plates 57 are arranged to abut on the outermost surfaces of the plurality of first spacers 93*a* placed on the outermost side in the first to third spacers 93*a* to 93*c* and outer surfaces of the small-diameter receiving pipes 56 in the storage composite 91 filling the drilled portion. As a result, the plurality of foam plates 57 surround the first to third spacers 93*a* to 93*c* between the horizontal connected unit 36 on the lowest level and the horizontal connected unit 33 on the second level from the bottom, surround the first to third spacers 93*a* to 93*c* between the horizontal connected unit 33 on the second level from the bottom and the horizontal connected unit 33 on the third level from the bottom, and surround the first to third spacers 93*a* to 93*c* between the horizontal connected unit 33 on the third level from the bottom and the horizontal connected unit 46 on the highest level. Here, if the foam plates 57 may possibly fall, temporarily fixing them by an adhesive tap is preferable. In this state, an outer peripheral portion of the impermeable sheet is mounted and laminated on the upper surface of the storage composite 11, whereby the storage composite 91 is wrapped together with the foam plates 57 with the impermeable sheet. At this time, since the upper end of each spindle pipe 16 abuts on the top panel main body 47*a* of each top panel 47, contact of each spindle pipe 16 with respect to the impermeable sheet can be avoided. As a result, the permeable sheet can be prevented from being damaged by the edge of each spindle pipe 16. Additionally, a gap between the side surface of the drilled portion and the impermeable sheet is filled with sand or soil.

In the storage composite 91 filling the storage tank in this manner, the horizontal connected units 36, 33, 33, and 46 configured by aligning the plurality of partitions 12 on the same horizontal plane and connecting them are provided on the plurality of levels (four levels), the first to third spacers 93*a* to 93*c* are interposed between the horizontal connected units 36, 33, 33, and 46 on the plurality of levels, and each spindle pipe 16 is vertically inserted into the insertion hole 12*a* of each partition 12 constituting each of the horizontal connected units 33 and 33 on the plurality of levels, and hence each spindle pipe 16 and each spacer 13 receive a partial pressure along the vertical direction in external force acting on the storage composite 91 whilst the horizontal connected units 33 which are integrated by coupling the plurality of levels in the vertical direction by each spindle pipe 16 receive a partial pressure along the horizontal direction in the external force acting on the storage composite 91. As a result, even the storage composite 91 formed by assembling the members having relatively simple shapes can assure strength as a relatively large structure. Furthermore, since the storage composite 91 is wrapped together with the foam plates 57 with the impermeable sheet, even if the partial pressure along the horizontal direction in the external force acting on the storage composite 91 acts on the impermeable sheet in a pressure-welding direction, the large-area flat surface of each foam plate 57 receives this external pressure. As a result, the impermeable sheet can be prevented from being damaged.

<Fourth Embodiment>

Figure 21:
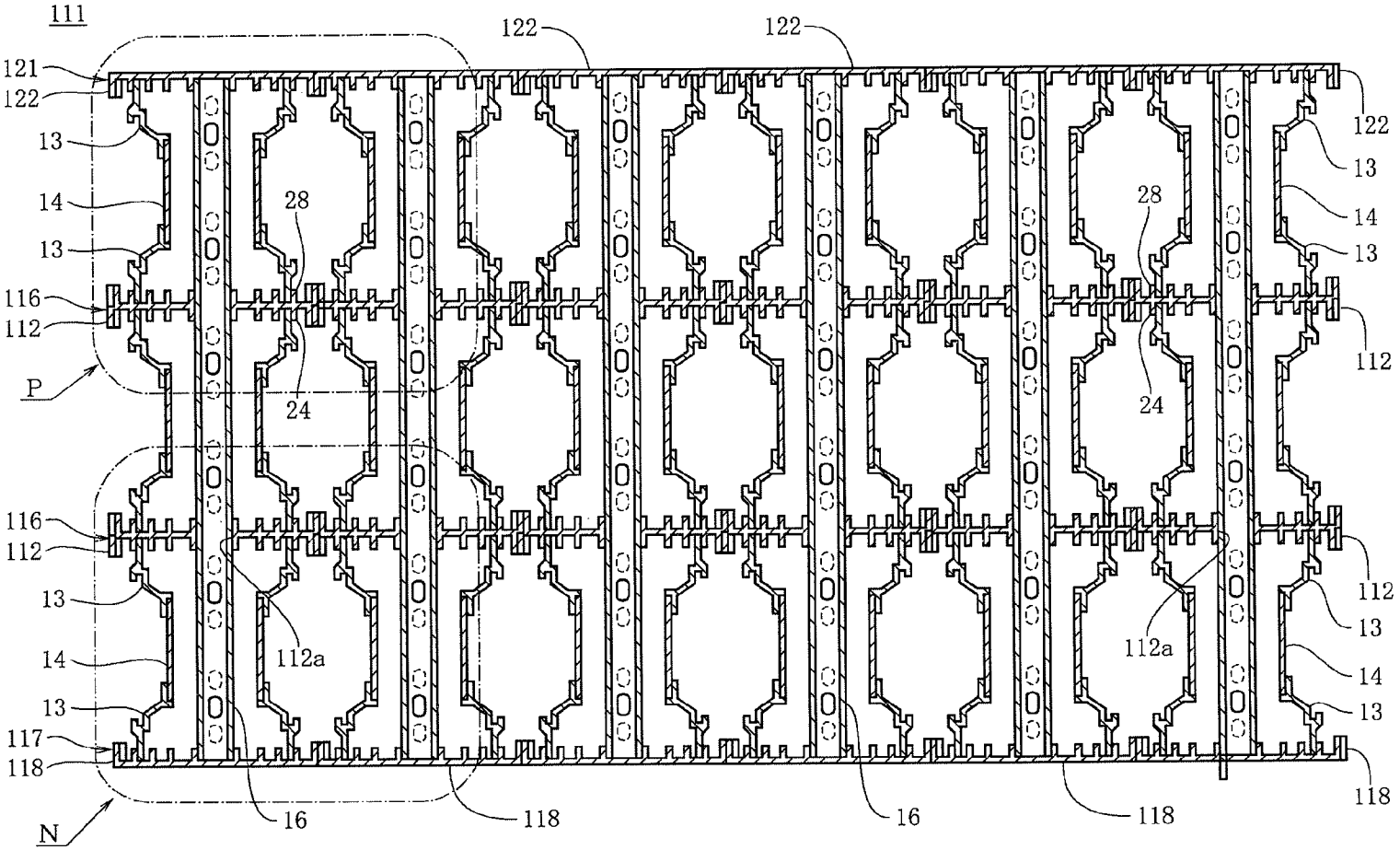
FIG. 21 is a cross-sectional view associated with FIG. 1, showing a state that a storage tank according to a fourth embodiment of the present invention is filled with storage composites.
Figure 22:
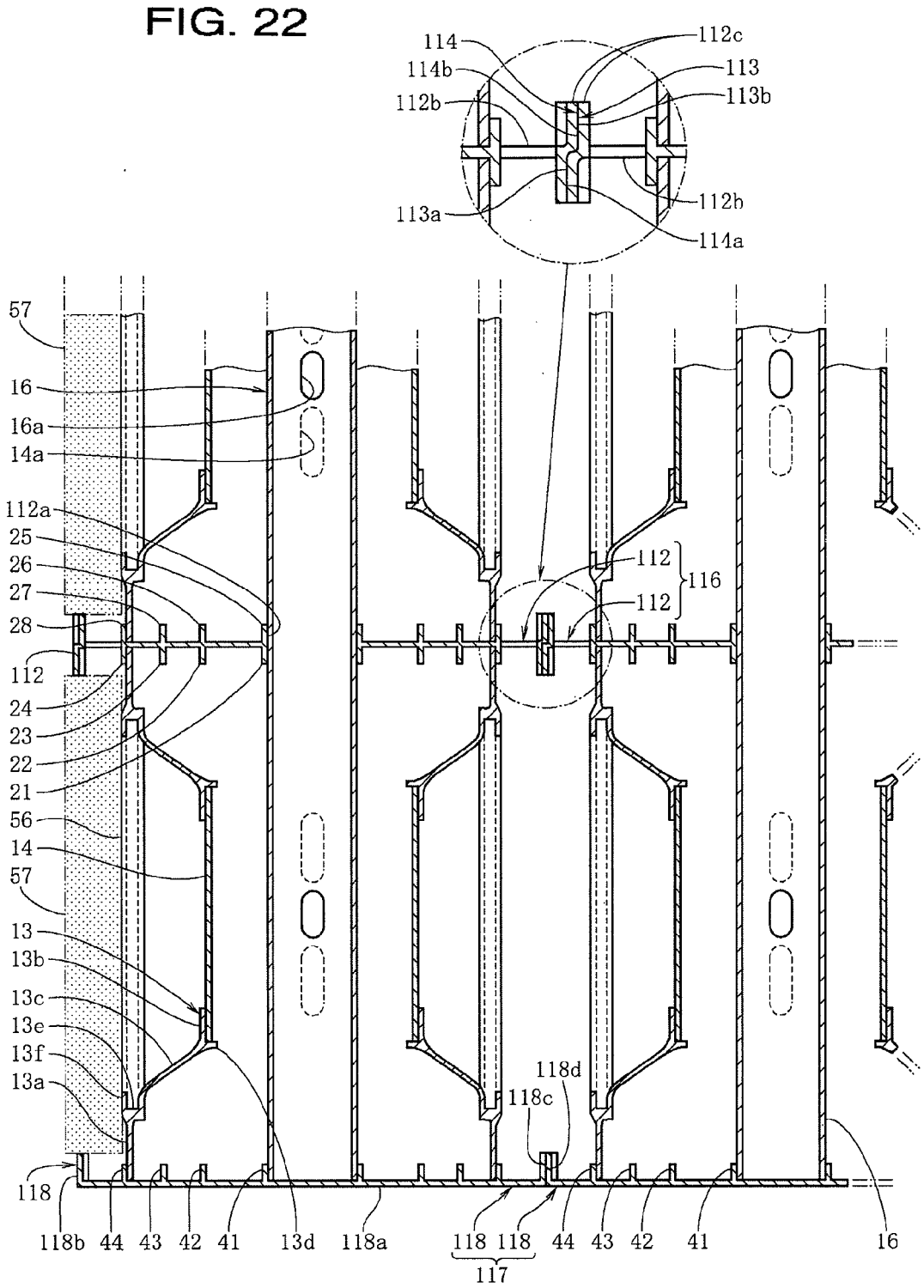
FIG. 22 is an enlarged cross-sectional view of a portion N in FIG. 21.
Figure 23:
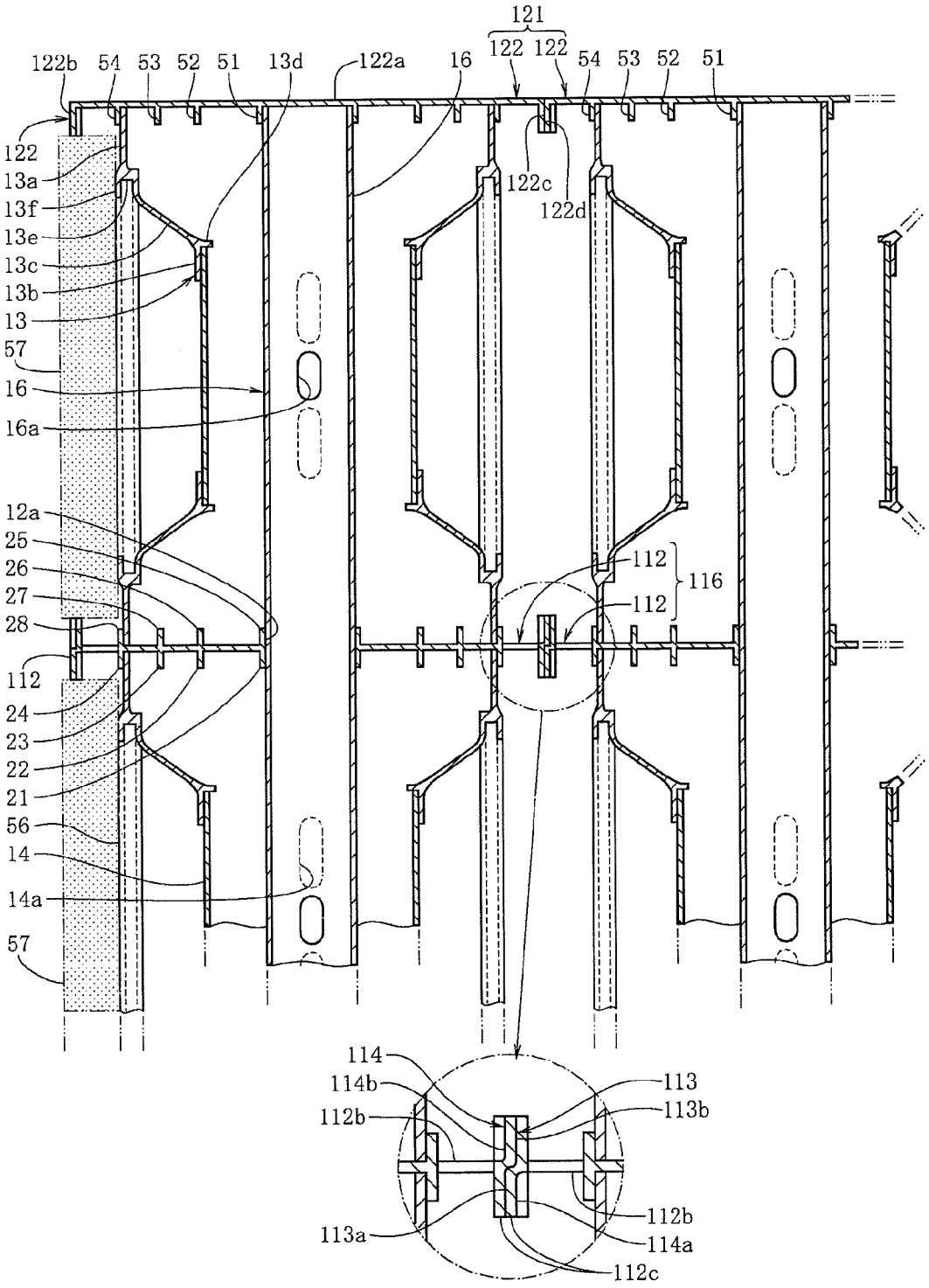
FIG. 23 is an enlarged cross-sectional view of a portion P in FIG. 21.
Figure 24:
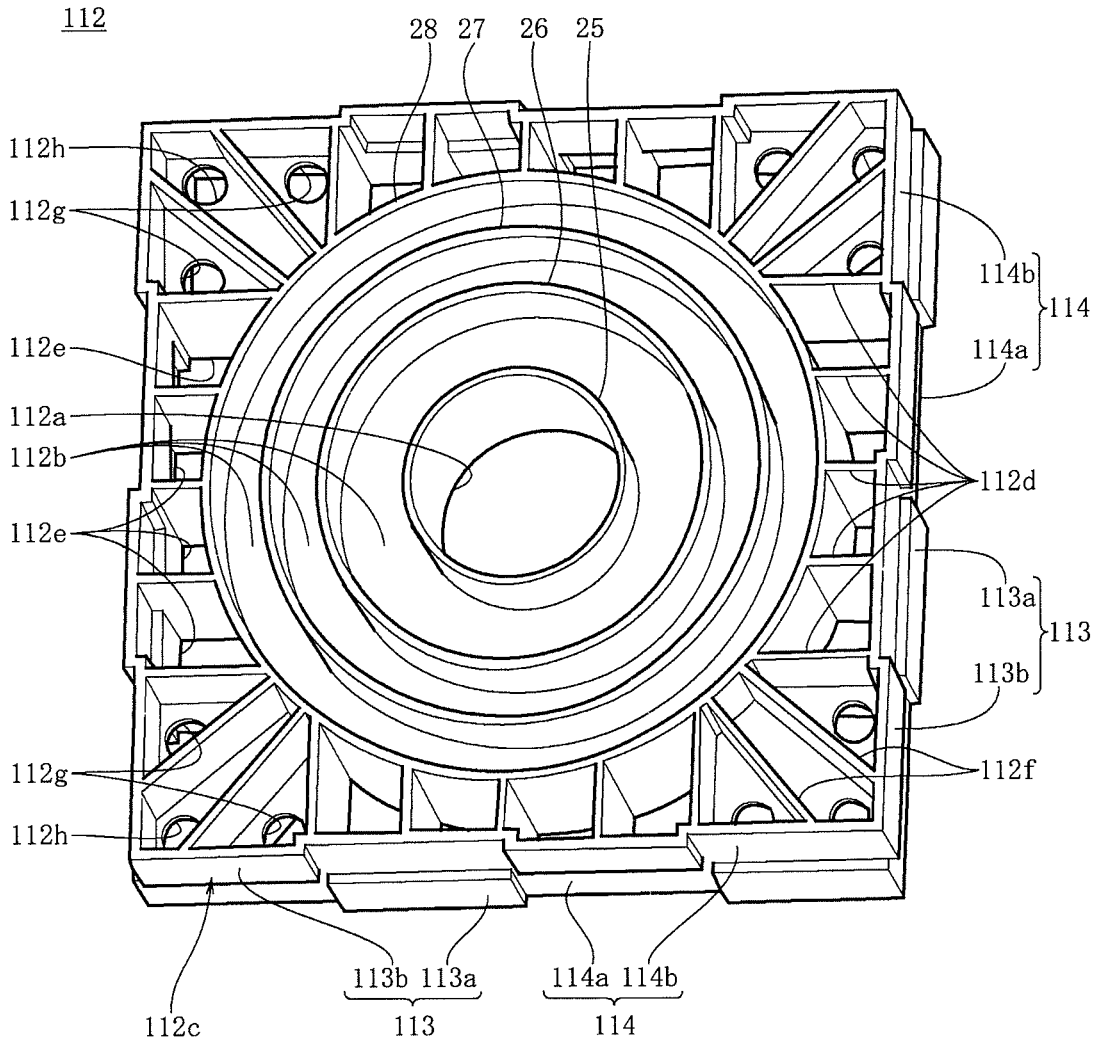
FIG. 24 is a perspective view showing a partition of the storage composite from an obliquely upper side.

FIG. 21 to FIG. 24 show a fourth embodiment according to the present invention. In FIG. 21 to FIG. 24, like reference numerals denote the same components as those in FIG. 1, FIG. 6, and FIG. 8. In this embodiment, each partition 112 has a partition main body 112*b* having a square plate shape with an insertion hole 112*a* formed at the center and a square tube rib 112*c* having a square frame shape protruded on the entire outer periphery of the partition main body 112*b* above and below this partition main body 112*b* (FIG. 22 to FIG. 24). Further, like the first embodiment, four first to fourth cylindrical ribs 21 to 24 are protruded on the lower surface of the partition main body 112*b* in the same direction (downward) as a protruding direction of the square tube rib 112*c* concentrically with the insertion hole 112*a*, and four fifth to eighth cylindrical ribs 25 to 28 are protruded on the upper surface of the partition main body 112*b* in the opposite direction (upward) of the protruding direction of the square tube rib 112*c* concentrically with the insertion hole 112*a*, respectively. The partition main body 112*b*, the square tube rib 112*c*, and the first to eighth cylindrical ribs 21 to 28 are integrally molded by using plastic such as a polyolefin resin (polypropylene, polyethylene, or the like) or a vinyl chloride resin. Further, at least one cylindrical rib protruded on the lower surface of the partition 112 corresponds to the fourth cylindrical rib 24, and at least one cylindrical rib protruded on the upper surface of the partition 112 corresponds to the eighth cylindrical rib 28.

It is to be noted that a plurality of reinforcing ribs 112*s* are extended and provided at portions between the square tube rib 112*c* of the partition main body 12*b* and the fourth and eight cylindrical ribs 24 and 28 except four corner portions in a substantially double-cross pattern, and a plurality of substantially square through holes 112*e* are formed between these reinforcing ribs 112*d* (FIG. 24). Furthermore, a plurality of reinforcing ribs 112*f* are extended and provided at the four corner portions of the partition main body 112*b* in a radial pattern, and a plurality of circular through holes 112*g* are formed in the partition main body 112*b* between these reinforcing ribs 112*f*. These through holes 112*e* and 112*g* are formed to spread rainwater or the like stored in a storage tank to the respective portions and prevent an air pocket from being generated in the storage tank. Moreover, reference sign 112*h* in FIG. 24 represents an engagement hole which is provided at each of the four corner portions of the partition main body 112*b* and with which a first or second engagement protrusion of a first or second connecting member that connects the adjoining partitions 112 with each other engages.

On the other hand, a convex portion 113 and a concave portion 114 are provided on each of four side surfaces of the partition 112. The convex portion 113 is formed of a plurality of first convex portions 113*a* having a rectangular plate shape which are provided on an outer peripheral surface of the square tube rib 112*c* on an upper side of the partition main body 112*b* along a longitudinal direction of the outer peripheral surface of the square tube rib 112*c* at predetermined intervals and a plurality of second convex portions 113*b* having a rectangular plate shape which are provided on the outer peripheral surface of the square tube rib 112*c* on a lower side of the partition main body 112*b* along the longitudinal direction of the outer peripheral surface of the square tube rib 112*c* at predetermined intervals (FIG. 22 to FIG. 24). Furthermore, the concave portion 114 is formed of a first concave portion 114*a* provided between the plurality of first convex portions 113*a* and a second concave portion 114*b* provided between the plurality of second convex portions 113*b*. Moreover, each first convex portion 113*a* is placed immediately below the second concave portion 114*b*, and the second convex portion 113*b* is placed immediately above the first concave portion 114*a*, whereby the first and second convex portions 113*a* and 113*b* and the first and second concave portions 114*a* and 114*b* are arranged on the outer peripheral surface of the square tube rib 112*c* in a reticular pattern (FIG. 24). Additionally, the first concave portion 114*a* is formed into a relatively shallow square shape associated with the first or second convex portion 113*a* or 113*b*, and the second concave portion 114*b* is formed into a relatively shallow square shape associated with the first or second convex portion 113*a* or 113*b*. Further, each first convex portion 113*a* of the partition 112 engages with the first or second concave portion 114*a* or 114*b* of the partition 112 adjacent to this partition 112, and each second convex portion 113*b* of the partition 112 engages with the second or first concave portion 114*b* or 114*a* of the partition 112 adjacent to this partition 112 (FIG. 22 to FIG. 24). It is to be noted that, although not shown, to couple the partitions 112 that are adjacent to each other through the first or second connecting member, it is preferable to reduce heights of the reinforcing ribs 112*f* at the four corner portions and the square tube rib 112*c* of each partition 112, increase a thickness of the first or second connecting member, and form concave grooves in portions facing the reinforcing ribs 112*f* and the square tube rib 112*c*.

On the other hand, each of a plurality of bottom plates 118 constituting a horizontal connected unit 117 on the lowest level has a bottom plate main body 118*a* having a square plate shape and a bottom plate square tube rib 118*b* having a square frame shape which is protruded on this bottom plate main body 118*a* over the entire outer periphery of the bottom plate main body 118*a* (FIG. 21 and FIG. 22). On an outer peripheral surface of the bottom plate square tube rib 118*b*, bottom plate convex portion 118*c* and a bottom plate concave portion 118*d* are alternately formed along a longitudinal direction of the outer peripheral surface of the bottom plate square tube rib 118*b* (FIG. 22). The bottom plate convex portion 118*c* is formed into the same shape as the first convex portion 113*a*, and the bottom plate concave portion 118*d* is formed into the same shape as the first concave portion 114*a*. Further, each of a plurality of top panels 122 constituting a horizontal connected unit 121 on the highest level has a top panel main body 122*a* having a square plate shape and a top panel angle tube rib 122*b* having a square frame shape which is protruded below this top panel main body 122*a* over the entire outer periphery of the top panel main body 122*a* (FIG. 21 and FIG. 23). On an outer peripheral surface of the top panel angle tube rib 122*b*, a top panel convex portion 122*c* and a top panel concave portion 122*d* are alternately formed along a longitudinal direction of the outer peripheral surface of the top panel square tube rib 122*b* (FIG. 23). The top panel convex portion 122*c* is formed into the same shape as the second convex portion 113*b*, and the top panel concave portion 122*d* is formed into the same shape as the second concave portion 114*b*. Further, the bottom plate convex portion 118*c* and the bottom plate concave portion 118*d* of the bottom plate 118 engage with the bottom plate concave portion 118*d* and the bottom plate convex portion 118*c* of the bottom plate 118 adjacent to this bottom plate 118, and the top panel convex portion 122*c* and the top panel concave portion 122*d* of the top panel 122 engage with the top panel concave portion 122*d* and the top panel convex portion 122*c* of the top panel 122 adjacent to this top panel 122, respectively. Other structures are the same as those in the first embodiment.

In the thus configured storage composite 111, even if the partitions 12 are turned over or any one of the four outer peripheral surfaces of the partition 112 is appressed against the partition 112 adjacent to this partition 112, the first convex portion 113*a* of the partition 112 engages with the first or second concave portion 114*a* or 114*b* of the partition 112 adjacent to this partition 112, and the second convex portion 113*b* of the partition 112 engages with the second or first concave portion 114*b* or 114*a* of the partition 112 adjacent to this partition 112. As a result, the partitions 112 can be relatively easily laid out. Further, since it is possible to assuredly avoid a displacement in a direction vertical to the adjacent partition 112 and a displacement in a direction horizontal to the same, the partitions 112 which are adjacent to each other can be firmly coupled. Furthermore, since the end surfaces of the first and second convex portions 113*a* and 113*b* protruding on the outer peripheral surface of the horizontal connected unit 116 obtained by aligning the plurality of partitions 112 on the same horizontal plane and connecting the same are flat surfaces each having a relatively large area, a member that is inserted along the outer peripheral surface of the horizontal connected unit 116 (e.g., the foam plate 57) or a member facing the outer peripheral surface of the horizontal connected unit 116 (e.g., the impermeable sheet or the permeable sheet) cannot be damaged.

On the other hand, even if any one of the four outer peripheral surfaces of the bottom plate 118 is appressed against the bottom plate 118 adjacent to this bottom plate 118, the bottom plate convex portion 118*c* and the bottom plate concave portion 118*d* of the bottom plate 118 engage with the bottom plate concave portion 118*d* and the bottom plate convex portion 118*c* of the bottom plate 118 adjacent to this bottom plate 118, respectively. As a result, the bottom plates 118 can be relatively easily laid out. Moreover, even if any one of the four outer peripheral surfaces of the top panel 122 is appressed against the top panel 122 adjacent to this top panel 122, the top panel convex portion 122*c* and the top panel concave portion 122*d* of the top panel 122 engage with the top panel concave portion 122*d* and the top panel convex portion 122*c* of the top pane 122 adjacent to this top panel 122, respectively. As a result, the top panels 122 can be relatively easily laid out. Operations other than those described above are substantially the same as the operations in the first embodiment, and hence overlapping explanation will be omitted.

It is to be noted that the storage tank filled with the storage composite has been taken as an example in the first to fourth embodiments, but a permeable storage tank filled with the storage composite may be used. This permeable storage tank is formed by graveling a bottom surface and a side surface of a drilled portion formed by drilling the ground to form a permeable layer or covering the bottom surface or the side surface of the drilled portion with a permeable sheet (a sheet through which rainwater gradually passes). According to this permeable storage tank, at the time of heavy rain whose rain intensity exceeds a discharge capacity of a sewage pipe or the like, rainwater that has flowed into the permeable tank is temporarily stored in this permeable tank, and then it seeps and spreads underground. As a result, the sewage pipe or a river can be prevented from overflowing. The permeable storage tank is filled with the storage composite according to the present invention, and foam plates are applied to the outermost surfaces of a plurality of end spacers placed on the outermost side of a plurality of end spacers of the filling storage composite, whereby the foam plates are configured to surround the plurality of end spacers and connecting spacers between respective horizontal connected units on a plurality of levels. Here, in case of wrapping the storage composite together with the foam plates with a permeable sheet, even if a horizontal partial pressure in an external pressure acting on the storage composite acts on the permeable sheet in a pressure-welding direction, a large-area flat surface of each foam plate receives this external pressure. As a result, an impermeable sheet can be prevented from being damaged.

Furthermore, in the first to fourth embodiments, the four cylindrical ribs are provided on each of the lower surface and the upper surface of each partition, the four bottom plate cylindrical ribs are provided on the upper surface of each bottom plate, and the four top panel cylindrical ribs are provided on the lower surface of each top panel, but three, five, or more cylindrical ribs may be provided on each of such surfaces. Moreover, the horizontal connected units are provided on the four levels in the first, third, and fourth embodiments, but these units may be provided on three, five, or more levels, and the horizontal connected units are provided on the three levels in the second embodiment, but these units may be provided on four or more levels. Additionally, although the description has been given as to the underground storage tank that is completely buried underground in the first to fourth embodiments, it is possible to adopt an aboveground storage tank that is installed on the ground without being completely buried or a semi-underground storage tank which is installed in such a manner that a lower portion thereof is buried underground and an upper portion thereof protrudes on the ground. Further, although the bottom plates and the top panels are used in the first to fourth embodiments, the partitions may be used as they are in place of the bottom plates and the top panels when a sheet for wrapping the storage composite is not used.

INDUSTRIAL APPLICABILITY

The storage composite according to the present invention can reduce the number of steps for manufacturing molds, which are used to form members, e.g., the partitions, the spacers, and others each having a relatively simple shape, by using these members, and it can be used as a filling material in the storage tank and the permeable storage tank.

EXPLANATIONS OF LETTERS OR NUMERALS

11, 71, 91, 111 storage composite
12, 112 partition
12*a*, 112*a* insertion hole
12*e*, 113 convex portion
12*f*, 114 concave portion

13 end spacer
13*a* large-diameter tube portion
13*b* small-diameter tube portion
14, 74 connecting spacer
16 spindle pipe
21 to 28 cylindrical rib
33, 36, 46, 116 horizontal connected unit
37 bottom plate
47 top panel
57 foam plate
93 spacer
113*a* first convex portion
113*b* second convex portion
114*a* first concave portion
114*b* second concave portion

The invention claimed is:

1. A storage composite for filling an inside of a storage tank or for filling an inside of a permeable storage tank, wherein said storage composite comprises:

a plurality of partitions having a square plate shape, each of said plurality of partitions has at least one cylindrical rib protruded on a lower surface thereof and at least one cylindrical rib protruded on an upper surface thereof;

a plurality of funnel-shaped end spacers, each of said plurality of funnel-shaped end spacers has a large-diameter cylindrical portion that is connected to one or both of the lower surface and the upper surface of each of said plurality of partitions, while said large-diameter cylindrical portion being fitted on a corresponding one of the at least one cylindrical rib protruded on a lower surface and the at least one cylindrical rib protruded on an upper surface, and a small-diameter cylindrical portion which is integral with the large-diameter cylindrical portion and has a diameter smaller than the large-diameter cylindrical portion; and a plurality of cylindrical connecting spacers, each of said plurality of cylindrical connecting spacers has both ends fitted in the small-diameter cylindrical portion of one of said plurality of funnel-shaped end spacers and extends in a vertical direction, wherein a diameter T of a portion of the at least one cylindrical rib protruded on a lower surface and the diameter T of a portion of the at least one cylindrical rib protruded on an upper surface, and fitted into the large-diameter cylindrical portion is set to fall within the range of 0.40 S to 0.95 S where S is a length of one side of each of said plurality of partitions, horizontal connected units, each of said plurality of horizontal connected units is configured by aligning the plurality of partitions on a horizontal plane and coupling the plurality of partitions, are provided on a plurality of levels, and the funnel-shaped end spacers and the connecting spacers are interposed between the horizontal connected units on the plurality of levels.

2. The storage composite according to claim 1, wherein an insertion hole is provided at a center of each of the plurality of partitions, and a spindle pipe is vertically inserted into the insertion hole of each partition constituting each of the horizontal connected units on the plurality of levels.

3. The storage composite according to claim 1, wherein a plurality of flat bottom plates are provided at the lower surface of each of the plurality of partitions constituting the horizontal connected unit on a lowest level, and a plurality of flat top panels are provided at the upper surface of each of the plurality of partitions constituting the horizontal connected unit on a highest level.

4. The storage composite according to claim 1, wherein each vertical interval between the horizontal connected units on the plurality of levels is configured to be larger on an upper side than on a lower side.

5. The storage composite according to claim 1, wherein a convex portion and a concave portion are provided on each of four side surfaces of each of said plurality of partitions, the convex portion of each of said plurality of partitions engages with the concave portion of an adjacent partition, and the concave portion of each of said plurality of partitions engages with the convex portion of an adjacent partition.

6. The storage composite according to claim 5, wherein each of said plurality of partitions comprises: a partition main body having a square plate shape; and a square tube rib having a square frame shape protruded on each of an upper side and a lower side of the partition main body over an entire outer periphery of the partition main body, each convex portion comprises: a plurality of first convex portions having a rectangular plate shape which are provided on an outer peripheral surface of the square tube rib above the partition main body in a longitudinal direction of the outer peripheral surface of the square tube rib at predetermined intervals; and a plurality of second convex portions having a rectangular plate shape which are provided on the outer peripheral surface of the square tube rib below the partition main body in the longitudinal direction of the outer peripheral surface of the square tube rib at predetermined intervals, each concave portion comprises: a first concave portion provided between the plurality of first convex portions; and a second concave portion provided between the plurality of second convex portions, the first convex portion is placed immediately below the second concave portion, the second convex portion is placed immediately above the first concave portion, and the first and second convex portions and the first and second concave portions are thereby arranged on the outer peripheral surface of the square tube rib in a reticular pattern, and the first convex portion of each of said plurality of partitions engages with the first or second concave portion of an adjacent partition, and the second convex portion of each of said plurality of partitions engages with the second or first concave portion of an adjacent partition.

7. A storage composite for filling an inside of a storage tank or for filling an inside of a permeable storage tank, wherein said storage composite comprises:

a plurality of partitions having a square plate shape, each of said plurality of partitions has an insertion hole provided at a center, a plurality of cylindrical ribs protruded on a lower surface thereof concentrically with the insertion hole, and a plurality of cylindrical ribs protruded on an upper surface thereof concentrically with the insertion hole;

a plurality of frustum cylindrical or cylindrical spacers connected to one or both the lower surface and the upper surface of each of said plurality of partitions so as to be movably inserted into any one of a plurality of ring grooves between the plurality of cylindrical ribs; and a spindle pipe inserted into the insertion hole of each partition, wherein horizontal connected units, which are configured by aligning the plurality of partitions on a horizontal plane and coupling the plurality of partitions, are provided on a plurality of levels, each of said plurality of spacers is interposed between the horizontal connected units on the plurality of levels;

each of said plurality of spindle pipes is vertically inserted into the insertion hole of each of the partitions constituting the horizontal connected units on the plurality of levels, a convex portion and a concave portion are provided on each of four side surfaces of each of said plurality of partitions, the convex portion of each of said plurality of partitions engages with the concave portion of an adjacent partition, and the concave portion of each of said plurality of partitions engages with the convex portion of an adjacent partition.

8. The storage composite according to claim 7, wherein each of said plurality of partitions comprises: a partition main body having a square plate shape, which has an insertion hole formed at a center; and a square tube rib having a square frame shape protruded on each of an upper side and a lower side of the partition main body over an enter outer periphery of the partition main body, each convex portion comprises: a plurality of first convex portions having a rectangular plate shape which are provided on an outer peripheral surface of the square tube rib above the partition main body in a longitudinal direction of the outer peripheral surface of the square tube rib at predetermined intervals; and a plurality of second convex portions having a rectangular plate shape which are provided on the outer peripheral surface of the square tube rib below the partition main body in the longitudinal direction of the outer peripheral surface of the square tube rib at predetermined intervals, each concave portion comprises: a first concave portion provided between the plurality of first convex portions; and a second concave portion provided between the plurality of second convex portions, the first convex portion is placed immediately below the second concave portion, the second convex portion is placed immediately above the first concave portion, and the first and second convex portions and the first and second concave portions are thereby arranged on the outer peripheral surface of the square tube rib in a reticular pattern, and the first convex portion of each of said plurality of partitions engages with the first or second concave portion of an adjacent partition, and the second convex portion of each of said plurality of partitions engages with the second or first concave portion of an adjacent partition.

9. A storage tank, wherein the storage tank is filled with the storage composite according to claim 1, and foam plates abut on outermost surfaces of a plurality of end spacers placed on an outermost side of a plurality of end spacers in the storage composite, and the foam plates thereby surround the end spacers and the connecting spacers between the horizontal connected units on the plurality of stages.

10. A storage tank, wherein the storage tank is filled with the storage composite according to claim 7, and foam plates abut on outermost surfaces of a plurality of spacers placed on an outermost side of a plurality of spacers in the storage composite, and the foam plates thereby surround the plurality of spacers between the horizontal connected units on the plurality of stages.

11. A permeable storage tank, wherein the permeable storage tank is filled with the storage composite according to claim 1, and foam plates abut on outermost surfaces of a plurality of end spacers placed on an outermost side of a plurality of end spacers in the storage composite, and the foam plates thereby surround the end spacers and the connecting spacers between the horizontal connected units on the plurality of stages.

12. A permeable storage tank, wherein the permeable storage tank is filled with the storage composite according to claim 7, and foam plates abut on outermost surfaces of a plurality of spacers placed on an outermost side of a plurality of spacers in the storage composite, and the foam plates thereby surround the plurality of spacers between the horizontal connected units on the plurality of stages.

* * * * *

UNITED STATES PATENT AND TRADEMARK OFFICE

CERTIFICATE OF CORRECTION

PATENT NO. : 9,079,708 B2
APPLICATION NO. : 13/978244
DATED : July 14, 2015
INVENTOR(S) : S. Takai It is certified that error appears in the above-identified patent and that said Letters Patent is hereby corrected as shown below:

In the claims

At column 27, line 46, please delete "set to fall" before within.

Signed and Sealed this
Fifteenth Day of March, 2016

Michelle K. Lee

Michelle K. Lee
*Director of the United States Patent and Trademark Office*